US006139639A

United States Patent [19]

Kitamura et al.

[11] Patent Number: 6,139,639

[45] **Date of Patent: *Oct. 31, 2000**

[54] COATING MACHINE HAVING A TIMER FOR CONTINUOUSLY FORMING A COATING OF UNIFORM THICKNESS ON A SUBSTRATE

[75] Inventors: Yoshiyuki Kitamura, Otsu; Hideo Ido, Takatsuki; Tetsuo Suzuki, Kusatsu; Kazuhiko Abe, Kusatsu; Hiromitsu Kanamori, Kusatsu; Tetsuya Goto, Otsu; Takayoshi Akamatsu, Otsu; Masaharu Tooyama, Otsu; Toshihide Sekido, Otsu, all of Japan

[73] Assignee: Toray Industries, Inc., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/700,421

[22] PCT Filed: Dec. 27, 1995

[86] PCT No.: PCT/JP95/02741

§ 371 Date: Aug. 28, 1996

§ 102(e) Date: Aug. 28, 1996

[87] PCT Pub. No.: WO96/20045

PCT Pub. Date: Jul. 4, 1996

[30] Foreign Application Priority Data

| | | | |
|---|---|---|---|
| Dec. 28, 1994 | [JP] | Japan | 6-328241 |
| Dec. 28, 1994 | [JP] | Japan | 6-328242 |
| Dec. 28, 1994 | [JP] | Japan | 6-329088 |
| Mar. 20, 1995 | [JP] | Japan | 7-061359 |

[51] Int. Cl.[7] ..... B05C 3/00

[52] U.S. Cl. ..... 118/680; 118/669; 118/682; 118/686; 118/687; 118/DIG. 2; 118/410

[58] Field of Search ..... 118/686, 687, 118/DIG. 2, 410, 680, 682, 669; 427/164, 165; 430/7

[56] References Cited

U.S. PATENT DOCUMENTS

| | | | |
|---|---|---|---|
| 3,526,535 | 9/1970 | Plumat | 118/DIG. 2 |
| 3,756,196 | 9/1973 | Furuuchi et al. | 118/DIG. 2 |

(List continued on next page.)

FOREIGN PATENT DOCUMENTS

| | | |
|---|---|---|
| 3-101866 | 4/1991 | Japan . |

(List continued on next page.)

*Primary Examiner*—Katherine A. Bareford
*Attorney, Agent, or Firm*—Birch, Stewart, Kolasch & Birch LLP

[57] ABSTRACT

A coating apparatus which comprises a feeding means to feed a coating liquid, a coating liquid applicator having a slot extending in one direction to discharge the coating liquid fed by the feeding means, and a conveying means to move at least either the coating liquid applicator or a substrate to be coated with the coating liquid relatively one to the other, comprising: (a) a first control means which comprises (a-1) a position detecting means to detect positions of the coating liquid applicator or the substrate which is moved by the conveying means, and (a-2) a controller capable of stopping the coating liquid applicator or the substrate which is moved by the conveying means at a position detected by the position detecting means such that a start-of-coating line of the substrate is in register with the slot of the coating liquid applicator and capable of starting the movement of the coating liquid applicator or the substrate which is stopped at the position; and (b) a second control means which comprises a timer controller capable of transmitting a signal to the controller of the first control means for the movement of the coating liquid applicator or the substrate which is stopped at the position after a desired period which begins with commencement of feeding the coating liquid and is needed for forming a coating liquid bead which is in contact with both the exit aperture of the slot of the coating liquid applicator and the substrate at the start-of-coating line.

4 Claims, 20 Drawing Sheets

U.S. PATENT DOCUMENTS

| | | | |
|---|---|---|---|
| 4,364,977 | 12/1982 | Bernardi | 118/686 |
| 4,735,169 | 4/1988 | Cawston et al. | 118/411 |
| 4,774,109 | 9/1988 | Hadzimihalis et al. | 427/286 |
| 4,810,527 | 3/1989 | Geary, Jr. et al. | 427/386 |
| 4,938,994 | 7/1990 | Choinski | 427/96 |
| 5,183,508 | 2/1993 | Cholinski | 118/683 |
| 5,409,733 | 4/1995 | Boger et al. | 427/96 |
| 5,538,754 | 7/1996 | Sandock | 118/410 |

FOREIGN PATENT DOCUMENTS

| | | |
|---|---|---|
| 4-100571 | 4/1992 | Japan . |
| 511105 | 1/1993 | Japan . |
| 5-142407 | 6/1993 | Japan . |
| 5-208154 | 8/1993 | Japan . |
| 6-170305 | 6/1994 | Japan . |
| 6-339656 | 12/1994 | Japan . |
| 7-328515 | 12/1995 | Japan . |

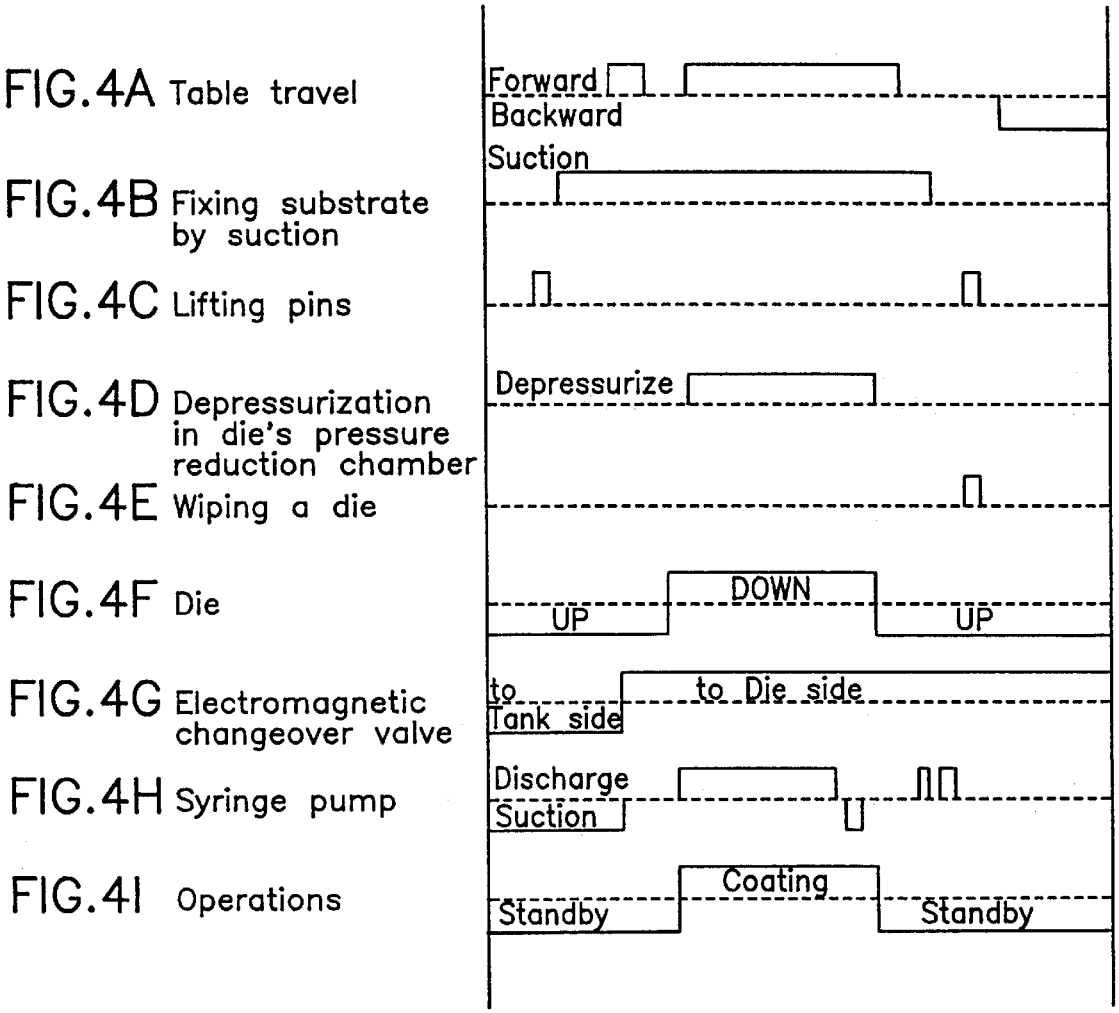
FIG.4A Table travel
Forward
Backward
FIG.4B Fixing substrate by suction
Suction
FIG.4C Lifting pins
FIG.4D Depressurization in die's pressure reduction chamber
Depressurize
FIG.4E Wiping a die
FIG.4F Die
UP
DOWN
UP
FIG.4G Electromagnetic changeover valve
to Tank side
to Die side
FIG.4H Syringe pump
Discharge
Suction
FIG.4I Operations
Standby
Coating
Standby FIG.25A Table travel
Forward
Backward
FIG.25B Fixing substrate by suction
Suction
FIG.25C Lifting pins
FIG.25E Wiping a die
FIG.25F Die
UP
DOWN
UP
FIG.25G Electromagnetic changeover valve
to Tank side
to Die side
FIG.25H Syringe pump
Discharge
Suction
FIG.25I Operations
Standby
Coating
Standby

COATING MACHINE HAVING A TIMER FOR CONTINUOUSLY FORMING A COATING OF UNIFORM THICKNESS ON A SUBSTRATE

The instant application is a national stage application of PCT/JP95/02741, filed Dec. 27, 1995.

TECHNICAL FIELD

The present invention relates to a coating method and coating apparatus for the application of coating liquids, particularly to a coating method and coating apparatus to produce stably a coating on a flat surface of a sheet substrate, which are suitable for application in electronic industrial areas such as semiconductor production. The invention also relates to a color filter manufacturing method based on said coating method, color filters thus manufactured, and a method for manufacturing coated sheet products such as color filters for liquid crystal displays and solid-state camera tubes, optical filters, printed circuit boards, integrated circuits and other semiconductor devices.

BACKGROUND ART

In recent years, the production of coatings through thin and uniform application of various coating liquids has been strongly demanded to form coatings over plastics substrates for optical filters, glass substrates for liquid crystal displays, and glass substrates for color filters, etc. and to form photoresists or protective layers on printed circuit boards or wafers, etc. in an integrated circuit or semiconductor manufacturing process. This requires the industrial-scale production of coatings on small-size substrates, in many cases less than 1 meter long in the coating direction, and necessitates the adoption of a sheet coating method which involves the feeding of substrates to the coater, one by one, application of coating liquids, and transfer of the coated substrates to the next process such as drying.

The methods which have been used conventionally and widely for such coating include the use of a spin coater, bar coater and roll coater.

Of these, the spin coater method which is widely used to form photoresist over a semiconductor wafer can apply coatings on a spinning substrate to be coated by dropping a droplet of coating liquid at the center of the substrate and spreading it over the surface by means of a centrifugal force. This method can produce uniform coatings over the entire surface of a substrate to be coated with a high thickness accuracy by choosing coating liquids suitable for this method. With the method, however, only several to ten percent of the coating liquid dropped on the surface of the substrate can be utilized for the actual formation of a coating, and the remainder, more than 90%, of that is removed from the surface and thrown away. Thus, a very large amount of coating liquid is required to obtain a film with a predetermined thickness, making the method uneconomical. In some cases, moreover, the coating liquid is deposited on an edge or the bottom surface of the substrate, or waste coating liquid scattered within the equipment gels or solidifies, which reduces stability and cleanliness, leading to degradation in the quality of the coated product.

The roll coater method involves the transfer of a coating liquid onto the surface of a substrate to be coated via a rubber roll, and is capable of applying a coating on a long material or on a continuous material wound onto a reel. However, since the coating liquid is supplied from a pan to an application roll and then to the substrate, exposure to the air becomes prolonged, which gives rise to vulnerability to degradation due to moisture absorption and oxidation, as well as the intrusion of foreign matter. As a result, degradation in the quality of the coated product tends to occur.

The bar coater method involves the application of a coating liquid onto a substrate to be coated using a bar made of a rod on which thin wire is wound. The problem with this method is that line marks are easily formed on the coating due to the contact between the wire wound on the rod and the coated substrate.

The die coater method, on the other hand, has been used conventionally and widely in areas where the production of thick coatings or continuous application of high-viscosity coating liquids is required. In case that a coating is formed on a substrate to be coated by using a die coater, the coating liquid is supplied through a slot of the die of the die coater to produce a pool of the coating liquid, called a coating liquid bead, between the die and the substrate which is moving relatively to the die running while maintaining a constant gap between them, and the coating liquid is pulled out as the substrate runs to form a coating, as has been disclosed, for example, in U.S. Pat. No. 3,526,535. Continuous production of a coating is possible by supplying the same amount of coating liquid as that consumed in the coating formation.

Thus, a coating produced with a die coater can achieve a uniform thickness with a considerable degree of accuracy. There is hardly any waste of coating liquid, and as the coating liquid supply path to the slot outlets is enclosed, the degradation of the coating liquid and intrusion of foreign matter can be prevented, thus enabling the method to enhance the quality of the resultant coating. This method also makes it possible to provide a rectangular-shaped coating at any desired position of a substrate to be coated.

In light of these problems associated with the spin coater, bar coater or roll coater method, a proposal to use the die coater method for the manufacture of color filters has been made recently in Japanese Patent Publication Laid-Open (Kokai) Nos. 5-11105 (1993) and 5-142407 (1993).

However, these die coaters lack a substantial history in their application to sheet substrates and are not sufficiently high in the levels of coating position accuracy, film thickness accuracy, reproducibility, stability, etc., which are essential for the continuous mass production of high quality coated products.

There seem to be four major technical reasons for this.

Firstly, adequate consideration has not been given to the formation and disappearance of a coating liquid bead, despite their importance for stable coating operations.

Namely, when a die coater is used to form a coating on substrate fed in a sheet-form, the application of the coating liquid inevitably becomes intermittent, so that disturbance of a coating liquid bead or disappearance of a coating liquid bead occurs at the start-of-coating line and/or the end-of-coating line on the substrate, regardless of whether the coating liquid is discharged continuously or intermittently. This makes it difficult to maintain a stable and suitable coating liquid bead over the entire coating area, and a uniform coating cannot be achieved until the bead reaches a stable state. If the stabilization of the bead requires a long time, it will lead to an increase in the area where the coating thickness is uneven, and the portion of the substrate which can be used effectively becomes extremely small. Regarding the formation and disappearance of a coating liquid bead, a method of producing a connecting bead, i.e. coating liquid bead, by generating pulses in supplying coating liquid has been disclosed in U.S. Pat. No. 4,938,994. However, by this method, the start-of-coating line cannot be accurately fixed since the substrate is moving while a coating liquid bead is formed and stabilized, and the length of the coated portion of the substrate before a coating liquid bead has been stably formed increases, thereby decreasing the portion of the substrate over which the required film thickness is obtained uniformly.

Secondly, no consideration is given to the relative positions of the substrate and the slot of the die. Where shifts occur to their relative positions or their reproducibility is poor, the position of the coated area may also shift, possibly with large fluctuations well beyond the allowable range. This is particularly crucial when a rectangular coating is to be formed on an inside portion of the surface of the substrate.

Thirdly, adequate consideration is not given to achieving a uniform clearance, i.e. the distance between the substrate and the exit face of the slot of the die, which has a major impact on the maintenance of a coating liquid bead.

Namely, when producing a coating with a uniform thickness on a substrate to be coated by using a die coater, the clearance must be kept constant over the entire width of the die of the die coater. The conventional way of keeping the distance from the substrate constant over the entire width of the die of the die coater is to measure the parallelism between the die and the substrate with a gauge etc. while the die is mounted on its support, and, if the parallelism between them is not satisfactory, manual adjustments to the condition of the die mounted on the support are made. Dies need to be washed regularly, since their continuous use gradually renders their interior dirty. However, if the adjustment work necessary after the mounting of the washed die onto the die coater is undertaken manually, it becomes cumbersome and requires a considerable amount of time to complete, which reduces the productivity. With manual adjustment, the accuracy of clearance depends on the workmanship of individual workers, making it impossible to always achieve a required accuracy with high reproducibility. In particular, when a thin coating is to be formed, a minute deviation in parallelism created through the adjustment process results in a large fluctuation in the thickness of the coating produced, greatly reducing the quality of the coating.

Moreover, the substrate itself fluctuates in thickness, and in addition, the vertical movement of the table carrying the substrate causes fluctuations in the clearance as the substrate travels. Depending on the severity, this can constitute an obstruction to improving the accuracy of coating thickness.

Usually, the linear slider which guides the table is provided by a linear motion guide. A linear motion guide here refers to a mechanism in which numerous balls are provided in such a way that not only can each of them rotate on its axis but they can also circulate along a predetermined path (hereinafter referred to as a revolution), so that the table can be moved smoothly as a result of the rotation and revolution of these balls.

However, when a table with a linear slider composed of a linear motion guide is used, the vertical movement of the table cannot be reduced to a low level because it undergoes considerable pitching and yawing. As a result, fluctuations in the clearance become large, making it impossible to control the coating thickness with high accuracy, i.e. to apply a uniform coating over the entire surface of the substrate.

A likely solution to this is the use of roller bearings in place of a linear motion guide to improve the traveling accuracy of the table, i.e. to reduce its vertical movement. However, as the traveling speed of the table increases up to a certain high-speed region, slipping starts to occur between the table support and roller bearings, which causes eventually the table supports to run off from the rollers, and a problem in that it is incapable of prolonged use under high-speed conditions.

Fourthly, there have been problems associated with the drying and heat curing of the coating liquid in the manufacturing of coated sheet products such as color filters, as described below.

Conventional methods of manufacturing coated sheet products such as color filters usually include drying and heat curing, by the oven method in which a coating liquid is applied over a glass substrate using a spin coater and then heated with the coated glass substrate held in a heated atmosphere, and by the hot plate method in which the coated glass substrate is placed on a hot plate. Coating by means of a spin coater takes some 60 seconds, and in addition, a considerable amount of the solvent in the coating liquid evaporates to accelerate the drying while the excess coating liquid is dissipated. This increases the concentration and viscosity of the coating liquid, resulting in a low fluidity at the end of the coating process. Therefore, the use of the oven or hot plate method to dry and heat-cure coatings rarely results in the spoiling of the coated surface due to external disturbances such as changes in the evaporation pattern, uneven temperature distribution and convection.

However, if a die coater and a spin coater are used to apply the same coating liquid on a glass substrate, the die coater is much shorter in the coating time compared with the spin coater, and in the absence of any particular factors which contribute to accelerated evaporation, the solvent does not evaporate much before the end of the coating process, so that the concentration, viscosity and liquidity of the coating liquid remain almost unchanged. Therefore, the use of the same drying and heat-curing method as in the case of a spin coater has so far resulted in coating defects. Namely, when the coating liquid is heat-cured using the hot plate method, marks of several pins used to support the glass substrate, marks of the arm used to convey the substrate and marks of the hot plate notches provided for the conveyance tend to be left undesirably on the coating. This problem occurs as the pins, arm and notches come into contact with the glass substrate, and this causes an uneven temperature distribution due to localized increases or decreases in the temperature of the affected parts of the glass substrate, resulting in a variation in the evaporation speed of the coating liquid solvent over the substrate surface. With the oven method, too, surface turbulence marks and other defects due to convection sometimes occur, if the heating temperature is raised too high in an attempt to increase the drying speed. Also, both methods may cause surface defects such as glossy spots, as the history of the evaporation process of the solvent remains on the surface of the coating.

Moreover, there is no known method suitable for manufacturing a coated product which comprises a rectangular coating formed on an inner portion of a surface of a sheet substrate. The simple utilization of a conventional method is fraught with problems such as surface imperfections, and in severe cases, the edge of such a rectangular coating on a substrate cannot be kept straight as a result of the coating liquid flowing out from a part of the edge of the rectangular region.

DISCLOSURE OF THE INVENTION

The present invention was made in light of the above problems, and its main object is to provide a coating method and coating apparatus which are capable of producing stably a uniform coating over a supplied substrate with good reproducibility and without compromising the advantages of a die coater, such as economy, high precision thin-film coating, and containing the coating liquid all the way. In particular, the invention is intended to provide a coating method and coating apparatus which can be favorably applied to sheet substrates, and to provide a method for manufacturing coated sheet products.

In more specific terms, the objects of the invention are as listed below:

First, a coating liquid bead necessary for a stable coating operation is to be formed at an early stage at the beginning of the coating process.

Second, accuracy in the relative positions of the die slot and the substrate is to be improved.

Third, the accuracy of the clearance in the width direction is to be improved to achieve a dramatic reduction of fluctuation in coating thickness in the direction of the width of the coating liquid discharger.

Fourth, fluctuation of the clearance in the traveling direction is to be reduced by introducing a linear slider provided with roller bearings which permit stable and smooth bi-directional traveling over a prolonged period without too much sacrifice of traveling speed and which can dramatically reduce vertical movements compared with the use of a linear motion guide.

Fifth, a method and apparatus for manufacturing coated sheet products such as color filters are to be provided by which high quality coated products, especially those high quality coated products with a rectangular-shaped coating portion formed on the inside surface of the substrate, can be produced without generating defects during the curing of the coating liquid applied over the substrate.

An embodiment of the coating method according to the present invention is a coating method, wherein a coating liquid feeder supplies a coating liquid to a coating liquid applicator having a coating liquid discharge slot, with at least either the coating liquid applicator or a substrate to be coated being moved relatively one to the other to form a coating with a predetermined thickness on the substrate, comprising the steps of: keeping at rest the substrate at a position where a start-of-coating line of the substrate is in register with the coating liquid discharge slot of the coating liquid applicator; commencing the discharge of the coating liquid through the coating liquid discharge slot; forming a coating liquid bead which is in contact with both an exit aperture of the coating liquid discharge slot and the start-of-coating line of the substrate; and subsequently commencing movement of at least either the coating liquid applicator or the substrate relatively one to the other.

A coating method of this embodiment makes it possible to accurately determine the start-of-coating line and produce a high accuracy coating, because by this method, after discharge of the coating liquid starts while the substrate to be coated is still at rest in register with the coating liquid discharge slot and the formation of the coating liquid bead is assured, the substrate is moved relatively to the coating liquid descharge slot while rendering the coating liquid bead stable.

Another embodiment of the coating method according to the present invention is a coating method wherein a coating liquid feeder supplies a coating liquid to a coating liquid applicator having a coating liquid discharge slot while a substrate to be coated is held and conveyed by a carrier to form a coating on the substrate, comprising the steps of: conveying the substrate by driving the carrier; stopping the substrate so that a start-of-coating line of the substrate lies below the coating liquid applicator; activating the coating liquid feeder to commence discharge of the coating liquid from the coating liquid discharge slot; forming a coating liquid bead over at an exit aperture of the coating liquid applicator throughout the slot in a widthwise direction; and subsequently commencing movement of the substrate using the carrier.

A coating method of this embodiment makes it possible to produce a highly accurate coating from the start-of-coating line, compared with other methods wherein the substrate starts moving before the completion of the formation of a coating liquid bead, because by this method dischare of the coating liquid through the coating liquid discharge slot is started by activating the coating liquid feeder after stopping the substrate so that the start-of-coating line of the substrate lies below the coating liquid applicator such as a die, and also because the conveying of the substrate using the carrier such as a table or a stage is started after forming a coating liquid bead over at the exit aperture of the coating liquid applicator throughout the slot in a widthwise direction. This makes it possible to increase the ratio of the length of the area over which the coating thickness is almost uniform to that of the overall coated area.

In an embodiment of the color filter manufacturing method according to the present invention, color filters are manufactured using a coating method as represented by one of the above embodiments.

A color filter manufacturing method of this embodiment makes it possible to supply extremely high quality color filters with high efficiency, as high accuracy coated products can be obtained without wasting the coating liquid.

In another embodiment of the color filter manufacturing method according to the present invention, color filters are produced by using a coating method as represented in one of the above embodiments to apply at least one of the following layers: protective layer, pigmented layer, photo-shielding resin layer and photoresist layer.

A color filter manufacturing method of this embodiment makes it possible to supply extremely high quality color filters having at least one of the following: protective layer with a low in-plane thickness fluctuation, pigmented layer or phto-shielding resin layer with a low in-plane fluctuation in spectral characteristics, and photoresist layer with a uniform coating thickness and a low dimensional fluctuation which permits high accuracy processing of pixels.

Yet another embodiment of the color filter according to the present invention is a color filter which is obtained by using either of the preceding color filter manufacturing methods.

A color filter of this embodiment can be an extremely high quality color filter which can have a pigmented layer and/or photo-shielding resin layer with a low in-plane fluctuation in chromaticity, a protective layer with a low in-plane thickness fluctuation, etc.

An embodiment of the coated sheet product manufacturing method according to the present invention is a coated sheet product manufacturing method comprising: (A) a step wherein at least either a coating liquid applicator having a coating liquid discharge slot or a sheet substrate to be coated is moved relatively one to the other, followed by keeping at rest the sheet substrate so that a start-of-coating line of the sheet substrate is maintained in register with the coating liquid discharge slot; (B) a step wherein a coating liquid is supplied from a coating liquid feeder to the slot of the coating liquid applicator, followed by commencing discharge of the coating liquid through the discharge slot; (C) a step wherein a coating liquid bead which is in contact with both the exit aperture of the slot of the coating liquid applicator and the start-of-coating line of the sheet substrate is formed, followed by commencing movement of at least either the coating liquid applicator or the sheet substrate relatively one to the other so that a coating with a predetermined thickness is formed on the sheet substrate; (D) a step wherein the coated sheet substrate with the coating is carried into a vacuum dryer; and (E) a step wherein the coated sheet substrate is dried under a pressure of 20 Torr or less and at a temperature in a range of 30° C.–180° C.

By a coated sheet product manufacturing method of this embodiment, a sheet substrate on which has a relatively large amount of solvent after the coating operation by a coating liquid discharger such as a die coater is dried under vacuum and at a relatively low temperature, and therefore the decrease in the viscosity of the coating liquid at the early stage of the drying process is minimized, which permits the prevention of the migration of the coating liquid due to external disturbances and warping of the coated substrate due to thermal strain, making it possible to cure the coating without sacrificing the high coating accuracy and smooth coating surface achieved during the coating process.

An embodiment of the coating apparatus according to the present invention is a coating apparatus which comprises a feeding means to feed a coating liquid, a coating liquid applicator having a slot extending in one direction to discharge the coating liquid fed by the feeding means, and a conveying means to move at least either the coating liquid applicator or a substrate to be coated relatively one to the other, comprising: a first control means by which a start-of-coating line of the substrate is kept at a position in register with the coating liquid applicator slot; and a second control means by which movement of at least either the coating liquid applicator or the substrate to be coated is commenced to move one relatively to the other after forming a coating liquid bead which is in contact with both the exit aperture of the slot of the coating liquid applicator and the start-of-coating line of the substrate.

By a coating apparatus of this embodiment, the substrate to be coated can be kept at rest at the predetermined position and the coating operation can be started after the formation of a coating liquid bead, making it possible to accurately fix the position of the start-of-coating line, produce a coating with high thickness accuracy, and achieve a constant thickness immediately after the start of the coating operation so that the useful coated area of the substrate can be increased.

Another embodiment of the coating apparatus according to the present invention is a coating apparatus which comprises a feeding means to feed a coating liquid, a coating liquid applicator having a slot extending in one direction to discharge the coating liquid fed by the feeding means, and a conveying means to move at least either the coating liquid applicator or a substrate to be coated relatively one to the other, comprising: a positioning means which determines a position of the substrate, before bringing the coating liquid applicator and the substrate close to each other.

By a coating apparatus of this embodiment, the substrate to be coated can be positioned on the carrier within a predetermined accuracy limit, and this eliminates misalignment in the width direction between the coating liquid discharger, such as a die, and the coated area on the substrate and also eliminates shift in the start-of-coating line, allowing a coating to be produced accurately within a predetermined coating area. A significant shift in the position of the coating area could lead to a great fluctuation in the coating thickness at the beginning and/or the end of the coating area, but this does not happen with this embodiment of the coating apparatus since positioning is carried out accurately, and a uniform coating thickness can be achieved throughout the coating area with little fluctuation and great reproducibility after repeated coating operations.

A still another embodiment of the coating apparatus according to the present invention is a coating apparatus which comprises a feeding means to feed a coating liquid, a coating liquid applicator having a slot extending in one direction to discharge the coating liquid fed by the feeding means, and a conveying means to move at least either the coating liquid applicator or a substrate to be coated relatively one to the other, comprising: a gap measurement means by which gaps between the bottom surface of the discharge outlet of the coating liquid applicator and the top surface of the carrier for conveying the substrate are measured at two predetermined positions spaced from each other prior to the commencement of the coating operation for the substrate, and a coating liquid applicator driving means which rotates the coating liquid applicator so that the two gaps become equal to each other.

By a coating apparatus of this embodiment, the thickness of the coating produced on the surface of the substrate to be coated can be made uniform over the entire width, because the parallelism between the bottom surface of the coating liquid discharger, such as a die, and the top surface of the carrier, such as a table, is first adjusted by rotating the coating liquid discharger to make the two gaps equal to each other prior to the beginning of the coating operation for the substrate, with a coating being produced subsequently on the surface of the substrate by allowing the carrier to move the substrate while discharging the coating liquid from the coating liquid discharger. The adjustment of the two gap readings between the coating liquid discharger and the carrier, i.e. the adjustment of their parallelism, can be carried out with high reproducibility and high accuracy, since it does not rely on human skills. The adjustment of parallelism can be carried out using a method other than the rotation of the coating liquid discharger, as long as it is capable of moving each end of the coating liquid discharger individually.

Another embodiment of the coating apparatus according to the present invention is a coating apparatus which produces a coating on a surface of a substrate by discharging a coating liquid from a coating liquid applicator while moving the substrate by means of a table which carries the substrate, comprising: the table supported by roller bearings on a base so as to travel back and forth freely along a predetermined direction while a driving force is transmitted via a ball screw mechanism, and a stopper to block forcibly the movement of the roller bearings, which is provided at a predetermined location near the limit of the roller bearings movement caused by a bi-directional travel of the table.

By a coating apparatus of this embodiment, if the table carrying the substrate to be coated reaches a high traveling speed which leads to cause slip between the table and the roller bearing, the possibility of the roller bearing moving to its movement limit in either direction due to a difference between the table's forward and backward traveling speeds can be eliminated, because a roller bearing stopper to block the movement of the roller bearing is provided at a predetermined location near the limit of the roller bearing movement which accompanies the bi-directional travel of the table. This makes it possible to maintain a high traveling speed for the table, and allows long term stable and smooth bi-directional movement. As a result, it becomes possible to introduce a roller bearing which allows the clearance between the bottom surface of the coating liquid discharger and the top surface of the substrate to be maintained with high accuracy as the substrate travels along. It is preferable that the roller bearing stopper has a shock absorbing substrate to block the movement of the roller bearing softly, which serves to extend the life of the roller bearing by mitigating damage.

Another embodiment of the coating apparatus according to the present invention is a coating apparatus which produces a coating on a surface of a substrate by discharging a coating liquid from a coating liquid applicator while moving the substrate by means of a table which carries the substrate, comprising: the table supported by roller bearings on a base so as to travel back and forth freely along a predetermined direction while a driving force is transmitted via a ball screw mechanism, a table lifter provided so as to lift up the table when the table has repeated its back-and-forth movement a predetermined number of times, and a roller bearing backward mover provided so as to move the roller bearings backwards following a lift of the table by the table lifter.

By a coating apparatus of this embodiment, the possibility that an excessively increased speed of the table carrying the substrate to be coated may cause slip between the table support and the roller bearing to allow the table to reach its movement limit to hamper the function of the roller bearing can be eliminated by moving the roller bearing backwards before the roller bearing reaches its movement limit. This also makes it possible to introduce a roller bearing which contributes to the improvement of the accuracy of the clearance.

BRIEF DESCRIPTION OF THE DRAWINGS

FIG. 4 shows a time chart of the operation of each device used in a die coater embodiment.

Symbols shown on the drawings stand for the following:

BEST MODE FOR CARRYING OUT THE INVENTION

The best mode for carrying out the invention is described below with reference to the drawings.

Figure 1:
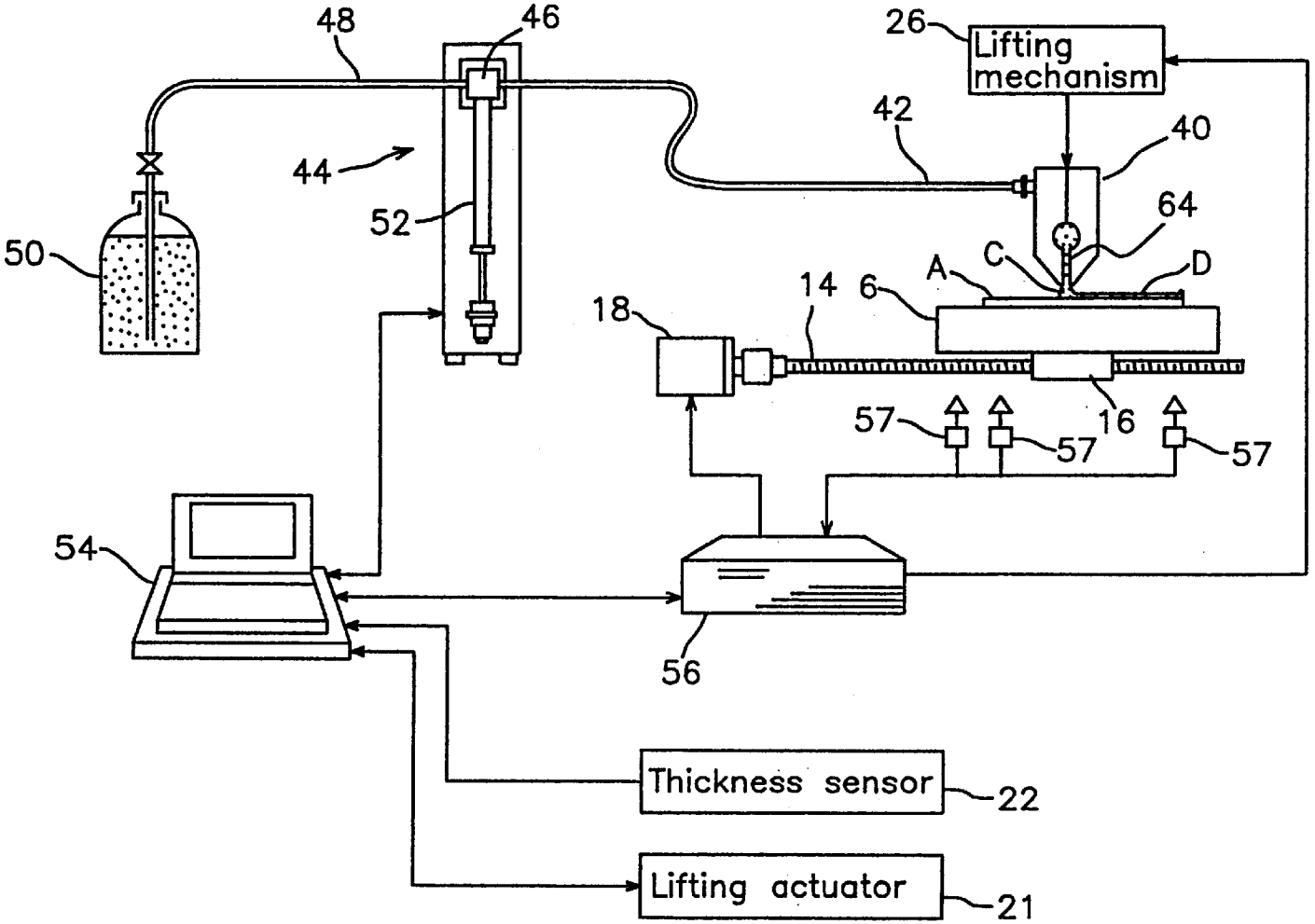
FIG. 1 shows a schematic diagram of a die coater including the coating liquid supply system.

FIG. 1 shows an overall configuration of an apparatus for performing a coating method according to the present invention.

This coating apparatus for a sheet substrate has a coating liquid tank 50; a syringe pump 44; a die 40 which is the coating liquid discharger provided with a coating liquid discharge slot 64; a table 6 which is moved in back-and-forth directions by a driving mechanism comprising a feed screw 14 and a threaded nut-like connector 16; a position sensor 57 comprising an optical sensor which detects the position of a glass substrate A, i.e. the substrate to be coated, placed on the table 6; a sequencer 56 which controls the output signal from the position sensor 57 and, AC servomotor 18 which powers the feed screw 14; and a computer 54 which controls the sequencer 56 and the syringe pump 44.

A coating liquid delivery hose 42 stretches from the die 40, and the end of the delivery hose 42 is connected to the delivery port of an electromagnetic changeover valve 46 for the syringe pump 44. A suction hose 48 runs from the suction port of the electromagnetic changeover valve 46, and the end of this suction hose 48 is connected to a coating liquid feed tank 50.

The pump proper 52 of the syringe pump 44 is selectively connectable to either the delivery hose 42 or suction hose 48 via the changeover action of the electromagnetic changeover valve 46. The electromagnetic changeover valve 46 and the pump proper 52 are electrically connected to the computer 54, and their operation is controlled by control signals from the computer 54. The lifting actuator 21 and thickness sensor 22 are also electrically connected to the computer 54. The syringe pump used here is a piston-type constant volume dischargeable pump, but a positive displacement pump such as a gear pump or a diaphragm pump may also be used as a constant volume dischargeable pump for this invention. The syringe pump comprises of a piston and a cylinder, and the preferred substrates for them include stainless steel and other metals, glass (like in a syringe), and ceramics, while plastics and polymer resins such as Teflon may also be used depending on the type of the coating liquid. It is also possible to limit the use of plastics and polymer resins such as Teflon to parts of the piston which come into contact with the coating liquid.

Figure 2:
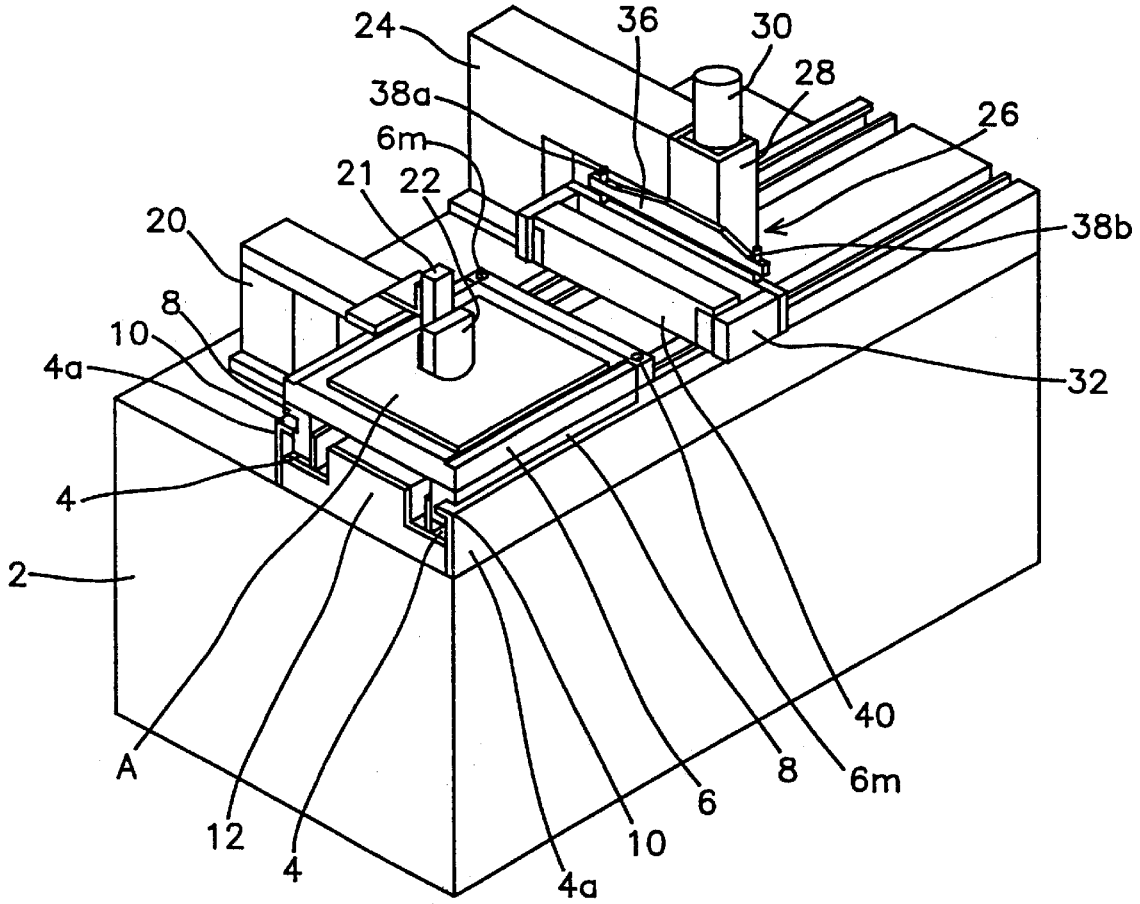
FIG. 2 shows an isometric projection of a die coater embodiment.

To control the operation of the syringe pump 44, a sequencer 56 is also connected to the computer 54. The sequencer 56 performs the sequential control of the AC servomotor 18 for the feed screw 14 on the side of the table 6 and the AC servomotor 30 (not shown on the drawing) for the lifting mechanism 26 (FIG. 2). For this sequential control, the sequencer 56 receives signal inputs such as those indicating the operational status of the AC servomotors 18 and 30, those from the position sensor 57 which detects the position of the table 6, and those from a sensor (not shown on the drawing) which detects the operational status of the die 40. From the sequencer 56, signals indicating their sequential operation are then sent to the computer 54.

Instead of using a position sensor 57, it is also possible to incorporate an encoder into the AC servomotor 18 and allow the sequencer 56 to detect the position of the table 6 based on the pulse signal outputted by the encoder.

Although not shown on the drawing, the die coater is equipped with a loader to load the table 6 with a glass sheet A for a color filter as sheet substrate to be coated and an unloader to remove the glass sheet A from the table 6, and the loader and unloader may have an industrial cylindrical coordinates robot etc. as their major component.

FIG. 2 is an overall oblique view showing the relationship between the die 40 and the table 6. A pair of groove and rail guides 4 are provided on the bench 2, and the table 6 is mounted on the groove and rail guides 4, with the top surface of the table 6 being a suction surface. The table 6 can move freely on a horizontal plane along the pair of groove and rail guides 4, i.e. a linear slider, in two opposite directions.

The pair of groove and rail guides are housed inside a casing 12, along with an advancing mechanism. The casing 12 stretches along the groove and rail guides 4. The advancing mechanism has a feed screw 14 comprising a ball screw as shown in FIG. 1. The feed screw 14 (FIG. 1) is located underneath the table 6, is screwed and extends through a nut-like connector 16 (FIG. 1) which is joined onto the stem 8. The two ends of the feed screw 14 are allowed to rotate freely, supported by bearings which are not shown, and an AC servomotor 18 (FIG. 1) is connected to one end. The smallest possible openings are provided on the top surface of the casing 12 to allow the movement of the stems 8.

The casing 12, with its very small openings, completely covers the groove and rail guides 4, feed screw 14, etc. thus dramatically reducing the escaping and scattering of the dust generated by the feed screw 14 etc. and preventing coating liquid dripping from a height above the table 6 from undesirably reaching the feed screw 14 and groove and rail guides 4. Furthermore, by drawing out the air inside the casing 12 and thus bringing the air pressure there down to a negative value, it is possible to increase the cleanliness of the atmosphere during the application of coating liquid and dramatically reduce the occurrence of defects, as this, along with the small size of the openings, will tend to prevent the dust generated inside the casing 12 from escaping, while sucking in the dust floating outside.

A sensor support 20 is placed on the top surface of the bench 2. The sensor support 20 has an inverted L-shape, and its end extends to a point right above one of the groove and rail guides 4. An electric-motor-driven lifting actuator 21 is mounted at the end of the sensor support 20, and a thickness sensor 22 is secured onto the lifting actuator 21 facing down. The thickness sensor 22 may be a laser displacement gauge, electronic micro-displacement gauge, ultrasonic thickness gauge or the like.

Also, an inverted L-shaped die support 24 is placed on the top surface of the bench 2, at a location closer to the center of the bench 2 than the sensor support 20. A lifting mechanism 26 is mounted at the end of the sensor support 24, and, although not shown in detail in FIG. 2, the lifting mechanism 26 is equipped with a lifting bracket which is engaged with a pair of guide rods in such a way that it can move up and down freely. A feed screw comprising a ball-screw is provided between the guide rods, and the feed screw is screwed through the lifting bracket. The upper end of the feed screw is secured onto a casing 28 which accommodates the guide rods and feed screw, via a bearing in such a way that it can rotate freely, and its top portion is connected to the AC servomotor 30.

An U-shaped die holder 32 is mounted on the lifting bracket in such a manner that it can freely rotate in the vertical plane, and the die holder 32 stretches horizontally straddling the pair of groove and rail guides 4. A little above the die holder 32, a horizontal bar 36 is secured onto the lifting bracket, with the horizontal bar 36 stretching alongside the die holder 32. Adjustment actuators 38*a* and 38*b* which are driven by air pressure are mounted at either end of the horizontal bar 36. Each of the adjustment actuators, 38*a* and 38*b*, has an extendible rod which protrudes from the bottom surface of the horizontal bar 36, and the two rods extend to touch the die holder 32 near its ends.

Inside the die holder 32, a die 40 is mounted as a means of discharging the coating liquid.

As is clear from FIG. 2, the die 40 lies over the pair of groove and rail guides 4, stretching horizontally in the width direction, i.e. perpendicular to the traveling path of the table 6. The horizontal level adjustment of the die 40 can be carried out by extending or retracting the extensible rods of adjustment actuators 38*a* and 38*b* which are mounted at both ends of the horizontal bar 36, and rotating the die holder 32 around its rotational axis, thus maintaining the bottom surface of the die 40 and the top surface of the table 6 parallel to each other.

A distance sensor 6*m* comprising an electromagnetic induction type sensor, electronic micro-displacement gauge, etc., for measuring the distance between the bottom surface of the die 40 and the top surface of the table 6, is mounted on the table 6 at each of its upstream side corners with respect to the coating direction. Other possible choices for the distance sensor 6*m* include a photoelectric sensor, ultrasonic sensor and differential transformer type contact sensor. The die is mounted in such a way that it can freely rotate around an axis which is parallel to the longitudinal axis of the die, and consideration has been given to facilitate the discharge of air trapped inside the die by discharging the coating liquid from the discharge outlet 66 (FIG. 3) facing upwards.

Figure 3:
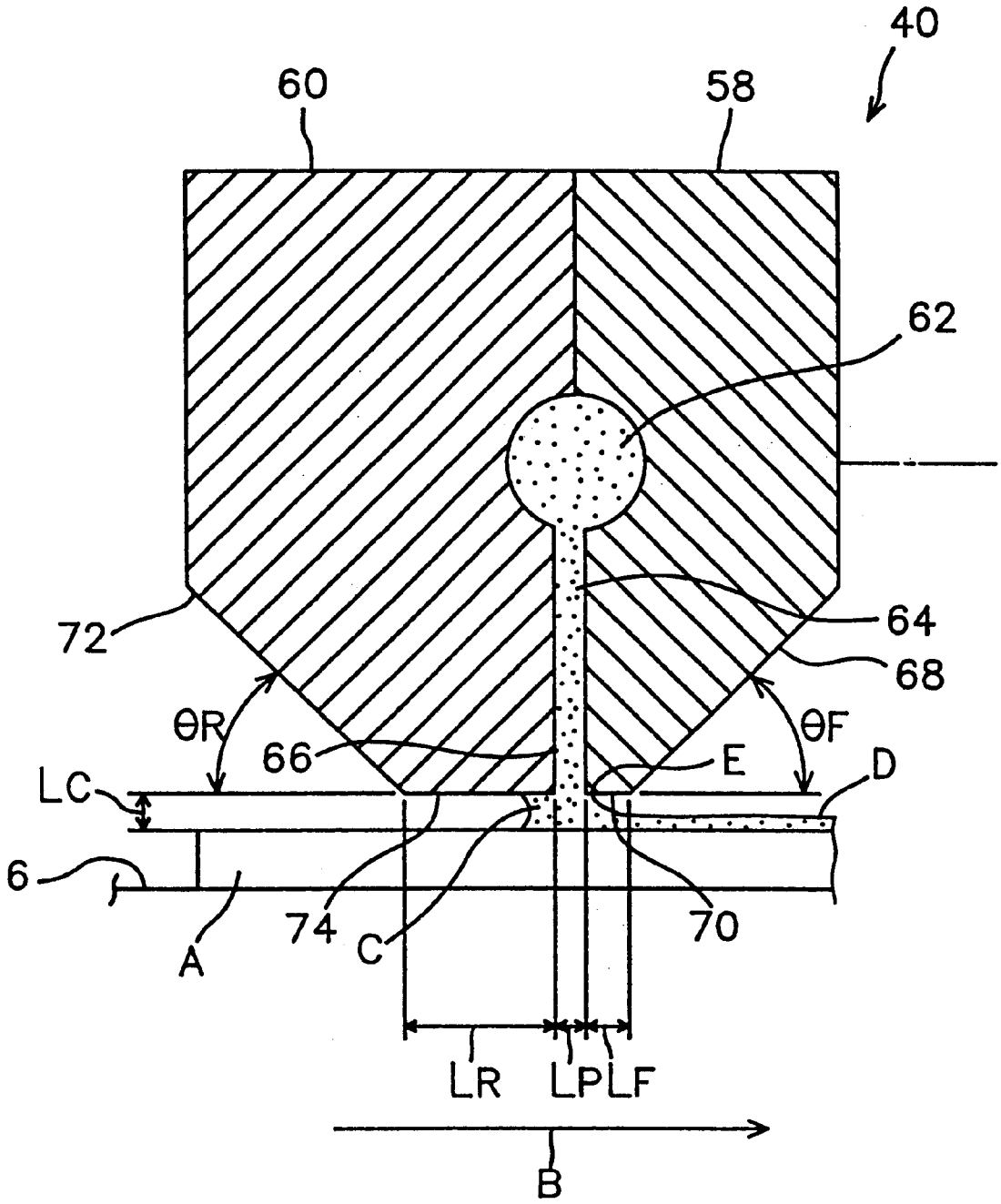
FIG. 3 shows a sectional view of a die used in a die coater embodiment.

The details of the die 40 are given in FIG. 3, in which the rotational axis of the die holder 32 and that of the die 40 are shown with a chain line. The die 40 has a front lip 58 and a rear lip 60 which are slender blocks extending in the width direction of the die. The lips 58 and 60 are put firmly together in the traveling direction of the table 6 with the front lip in front. In the middle of the die 40, a manifold 62 has been formed, and the manifold 62 stretches in the length direction of the die 40. The manifold 62 is permanently connected to the coating liquid supply hose 42 via an internal passage. The cross-sectional shape of the manifold may be a circle such as the one shown in FIG. 3, semi-circle, inverted triangle, or any other shape which is wider than the gap LP of the slot 64 and capable of holding a liquid. Concerning the lengthwise changes in cross-section of the manifold, the cross-section may be the same throughout its length, i.e. so-celled T-shape manifold, or may gradually increase towards the middle in the length direction of the die to ensure a smooth flow, i.e. so-called coat-hanger type or fish-tail type.

The slot 64 extends vertically downwards from the manifold 62, and opens through the bottom surface of the die 40. The bottom opening of the slot 64, i.e. the discharge outlet 66, extends in the length direction of the die 40, in the same manner as the manifold 62. More specifically, a shim (not shown on the drawing) is placed between the front lip 58 and rear lip 60, and the thickness of the shim is used to adjust the gap LP of the slot 64, i.e. the length of the discharge outlet 66 in the traveling direction of the table 6, to, for example, 0.1 mm.

When looking in the forward traveling direction of the table 6 (the one marked "B" in FIG. 3), i.e. the direction in which the table 6 at its initial position as shown in FIG. 1 moves towards the die 40, the lower part of the front face of the front lip 58 which is situated at the front is shaped into a downward slope 68 inclined towards the discharge outlet 66, and the bottom surface 70 of the front lip 58 is defined by the surface which lies between the lowest edge of the slope 68 and the discharge outlet 66. Similarly, the lower part of the rear face of the rear lip 60 is shaped into a downward slope 72 inclined towards the discharge outlet 66, and the bottom surface 74 of the rear lip 60 is defined by the surface which lies between the lowest edge of the slope 72 and the discharge outlet 66.

As is clear in FIG. 3, the length $L_R$ of the bottom surface 74 associated with the rear lip 60 in the traveling direction of the table 6 is greater than the length $L_F$ of the bottom surface 70 associated with the front lip 58, and these bottom surfaces 70 and 74 lie in the same horizontal plane.

For example, the length $L_F$ of the bottom surface 70 is set to 0.01–0.5 mm, and the length $L_R$ of the bottom surface 74 is set to 1 mm or more and 4 mm or less.

Moreover, the angle $\theta_F$ made by the sloped surface 68 associated with the front lip 58 and a horizontal plane which intersects with it is set between 30° or more and 60° and less. On the other hand, there is no particular constraint on the angle $\theta_R$ between the sloped surface 72 associated with the rear lip 60 and the horizontal plane, although it should preferably be set in a similar range to $\theta_F$.

To ensure fast response of coating liquid discharge from a coating liquid discharger in the above configuration, it is necessary to secure firm sealing throughout the coating liquid delivery piping system. Although there is no particular limit on the thickness of the coating D which can be produced, the applicator can be used most favorably for the production of thin-film coatings within the range of 1–500 μm in thickness after application and before drying. When the thickness of the coating D is less than 1 μm, it is difficult to obtain high uniformity due to restrictions in machining accuracy for the die 40 and thickness accuracy of the substrate A. Although it is of course applicable to cases where the coating thickness exceeds 500 μm, such an application will not markedly reflect the meritorious effects of the present invention.

The uniformity of the coating D is controlled by adjusting the slot gap $L_P$ of the die 40 or the clearance $L_C$, i.e. the length of the gap between the die 40 and the substrate A, as shown in FIG. 3. In the present invention, there are no particular restrictions as to the slot gap $L_P$ and clearance $L_C$, but the slot gap $L_P$ is preferably set in the range of 10–500 μm. Otherwise, the adverse effects of variance in gap lengths and undulations will be extremely great, as it is difficult to produce a die 40 to maintain a slot gap of less than 10 μm with high accuracy. Further, the clearance $L_C$ is preferably set in the range of 10 μm–1 mm, since maintaining a clearance $L_C$ of less than 10 μm with high accuracy is difficult due to constraints in the machining accuracy of equipment and substrates A. The clearance $L_C$ is also preferably 1 mm or less in view of maintaining the stability of the coating liquid bead C. Also, to obtain a highly uniform coating D by producing a stable coating liquid bead C, the clearance $L_C$ is preferably maintained precisely within an overall range of 1.2 to a few tens of times the coating thickness. A pressure chamber may be provided at the rear lip 60 side to adjust the positive or negative pressure on the upstream side surface of the coating liquid bead C as a means of facilitating the formation of a stable coating liquid bead C.

The slot gap variation in the width direction of the die can be freely adjusted using adjustment bolts, not shown in the drawing.

The coating method will now be explained with reference to typical time charts shown in FIG. 4, where Chart a represents the time chart of table travel, with the top half of the chart indicating forward movement and the bottom half of that indicating backward movement. Charts b and c show changes in the operation of adhering the substrate to be coated by suction and the operation of the lift pins for the table 6 (not shown in the drawing) with time, respectively, while Chart d indicates pressure reduction action in a case where a pressure reduction chamber is provided at the rear lip side of the die 40. Charts e and f illustrate the wiping action for the die 40 and the vertical movement of the die 40, respectively, while Chart g shows the operation of the electromagnetic changeover valve 46, with the top half of the chart indicating changeover to the coating die side and the bottom half of that to the coating liquid tank side. Chart h illustrates the operation of the syringe pump 44, with the top half of the chart indicating discharge and the bottom half of that indicating suction. Chart i explains an overall sequence of operations.

Although not shown in the drawing, there is a sensor which detects the position of the table 6 or that of the substrate A to be coated. This sensor may comprise a proximity sensor, photoelectric sensor or the like, or may be based on an encoder which detects the amount of revolutions made by the table-driving motor.

Figure 5B:
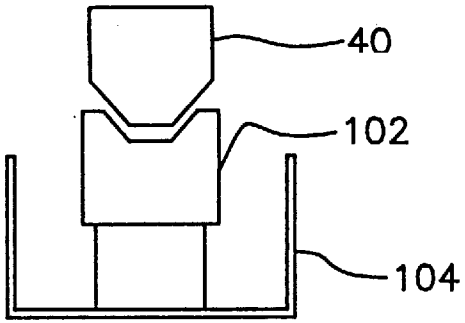
FIG. 5*b* shows an enlarged X—X sectional view of the wiping equipment shown in FIG. 5*a*.
Figure 5A:
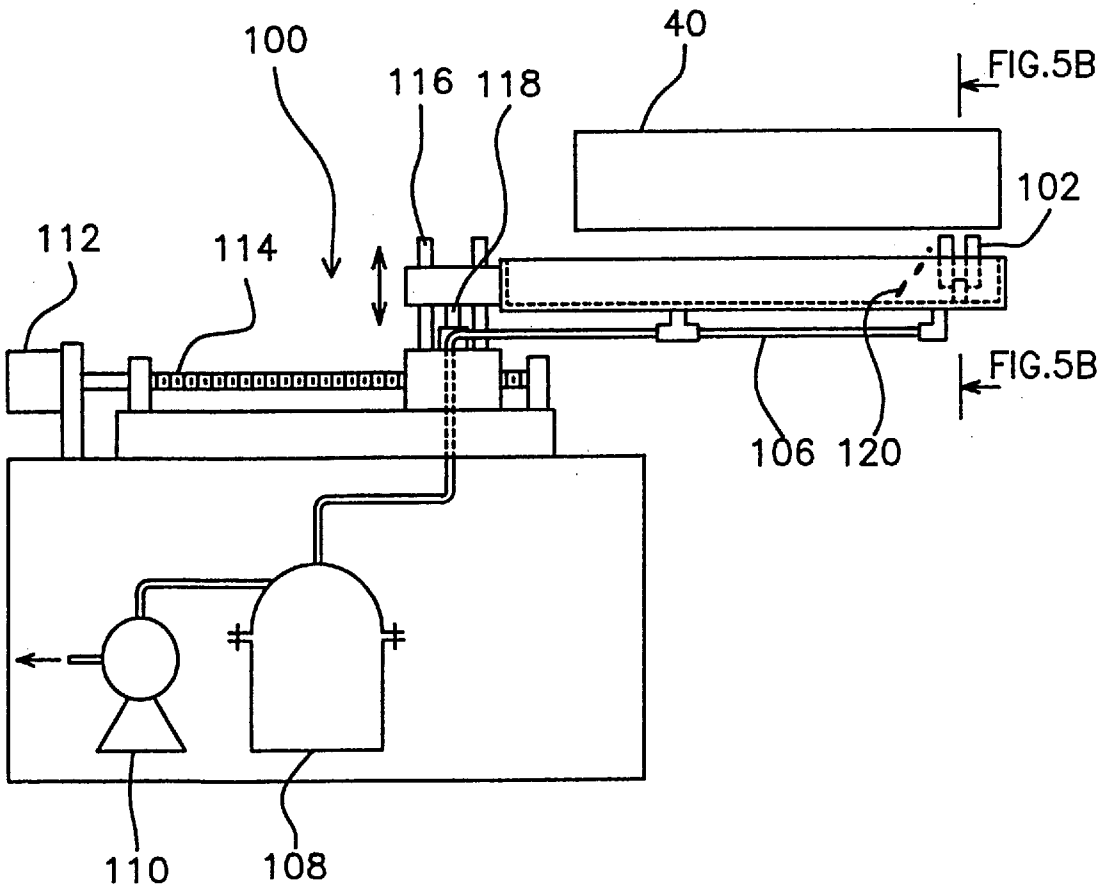
FIG. 5*a* shows a schematic diagram of a wiping equipment.

FIG. 5 shows an overall configuration of the wiping device.

This device makes the bottom surfaces 70 and 74 as well as the sloped surfaces 68 and 72 of the die 40 substantially even by wiping off left-over coating liquid using a plastic or rubber wiper 102, which is, after being pushed up via a cylinder 118 and pressed against these three surfaces at a predetermined pressure, moved towards one end of the die 40 in the width direction by means of a driving system comprising a motor 112 and a ball screw 114.

The coating liquid 120 thus removed is collected in a tray 104, which retains the wiper 102 and moves along with it, and is collected by sucking it into a waste liquid tank 108 via drainage piping 106 using a pump 110. A tray 104 can also be used for the collection of excess coating liquid generated during the non-coating period.

As is shown in the time charts given in FIG. 4, after resetting all the components of the coating apparatus to their respective original positions, the electromagnetic changeover valve 46 is changed over to the coating liquid tank 50, and suction operation is carried out using the syringe pump 44. After that, with the lift pins raised, the substrate A to be coated is transferred onto the lift pins from the loader, not shown in the drawing, and is placed onto the table 6 at a predetermined location by lowering the lift pins. The substrate A to be coated is then immobilized on the table 6 by means of vacuum suction. Apart from vacuum suction, a pinching lever based on a link mechanism, suckers, an adhesive sheet, etc. may also be used as a means of immobilizing (retaining) the substrate A on the table 6, and these are also included in the "means of retaining" as defined in the present invention.

After a predetermined amount of the coating liquid is sucked into the syringe pump 44 from the coating liquid tank 50, the electromagnetic changeover valve 46 is switched over to the die 40. The table 6 is moved in the forward direction to carry the substrate A to a position just below the die 40, where the forward traveling of the table 6 is stopped. The stopping position is determined by receiving a signal transmitted from the position sensor 57. The die 40 is then lowered, and a predetermined clearance $L_C$ is secured by means of a linear sensor or a positioning mechanism such as cotters. Instead, the substrate A to be coated may be moved in after lowering the die 40. After this, the discharge of coating liquid is started by activating the syringe pump 44 to supply coating liquid to the die 40, practically at the same time as the securing of the clearance $L_C$, and a predetermined coating bead C (FIG. 3) is formed between the die 40 and the substrate A throughout the width by keeping the table 6 at rest for a predetermined period after the beginning of the discharge of the coating liquid.

In FIG. 3, the volume V (in $mm^3$ or $\mu l$) of the coating liquid discharged from the discharge slot during the period where the table remains at rest after the beginning of discharge is preferably within the range given by the following formula:

$$L_P \times L_C \times W \leqq V \leqq (L_F + L_P + L_R) \times L_C \times W,$$

where $L_F$ (mm) is a length of the bottom surface of the front lip; $L_R$ (mm) is a length of the bottom surface of the rear lip; $L_P$ (mm) is a width of the slot exit aperture; $L_C$ (mm) is a distance between the slot exit aperture of the coating liquid applicator and the start-of-coating line on the substrate to be coated; and W (mm) is a length of the slot exit aperture in the direction perpendicular to the coating direction.

Namely, to ensure the formation of a satisfactory coating liquid bead, the volume of coating liquid V is preferably ($L_P \times L_C \times W$) or more, and, to prevent inconsistency in coating thickness resulting from a thick coating at the start-of-coating line due to the outflow of the coating liquid from the space defined by the bottom surface 70 of the die 40 and substrate A to be coated, the volume of coating liquid V is preferably $[(L_F + L_P + L_R) \times L_C \times W]$ or less.

After thus forming a coating liquid bead C, coating is started by moving the table 6 in the forward direction at a predetermined speed. The coating liquid bead C may be stabilized by reducing the air pressure in the pressure reduction chamber provided at the rear lip side of the die 40 to a predetermined value below the atmospheric pressure almost at the same time as the beginning of coating. With this stabilization of the coating liquid bead C, it is possible to quickly equalize the amount of the coating liquid consumed in the coating operation with that supplied via the discharge outlet 66 of the die 40, and achieve the normal coating condition quickly, thus enabling the production of a stable coating within a short period after the beginning of application.

Coatings are produced using the squeegee coating method, in which the supply of coating liquid by the syringe pump 44 is stopped when the substrate A to be coated arrives at a location which is a predetermined distance before the end-of-coating line, to finish off coating by consuming the coating liquid stored in the bead C. Instead, the supply of coating liquid may be stopped when the substrate A to be coated reaches the end-of-coating line.

If necessary, a predetermined amount of already discharged coating liquid may be recovered by suction via the discharge outlet 66 of the die 40 by reversing the operating direction of the syringe pump 44 when the substrate A to be coated reaches the end-of-coating line. In that case, the substrate A to be coated may temporarily be stopped at the end-of-coating line to ensure complete recovery of the coating liquid bead.

Coating is ended by raising the die 40 when it comes near the end-of-coating line in order to distance it from the coated substrate A. After that, the coating liquid is discharged by operating the syringe pump 44 to eliminate any discontinuity which may have been created at the discharge outlet 66 due to the recovery by suction of the coating liquid. The table 6 continues traveling in the forward direction, and the table stops when it reaches a predetermined point where the substrate A is transferred to the next process. There, the substrate A is raised by lifting the lift pins, with vacuum suction released, and at this position the substrate A is passed on to the unloader (not shown in the drawing). At the same time, the coating liquid left over on the slot exit surface of the die 40 is removed by wiping the die 40 after a small amount of liquid is discharged by the syringe pump 44. The table 6 then travels backwards, and returns to the original position to be loaded with a next substrate A to be coated. This marks the end of a coating operation cycle, and the equipment will start another coating operation cycle for a next substrate A.

In this coating process, coating may be finished with squeegee coating, without the reverse direction operation of the syringe pump at the end-of-coating line.

With this coating procedure, the clearance is accurately set by controlling the descent of the die 40 based on output signals transmitted from a distance sensor (not shown in the drawing) which measures the distance between the table 6 and die 40, while taking into account the thickness of the glass substrate A measured using the thickness sensor 22. Instead, the die 40 may be lowered to the predetermined position based on output signals transmitted from a linear sensor which measures the position of the die holder which supports the die 40.

The measurement of the thickness of the glass substrate A is carried out when loading of the glass substrate A is completed by securing it on the table 6 via suction, with the thickness sensor 22 moved down to a predetermined position. After measurement, the thickness sensor 22 is moved back to the original position.

The above sequence of operations makes it possible to determine the beginning and end of the coating area on the substrate A, since the coating operation takes place with the table 6 moved forward only after it is stopped at the start-of-coating line to ensure that a coating liquid bead C with a shape necessary for stable coating production is formed throughout the required coating width. It also makes it possible to dramatically reduce the distance from the edge of the substrate A to that of the area on which a usable coating can be formed (regular coating thickness area), since it can greatly reduce the variations in coating thickness at the beginning and end of the coating area from the coating thickness in the steady-state coating region to which the steady-state coating is applied, thus allowing the portion of the substrate A on which a useful coating can be produced to be increased in terms of the ratio of its length to the entire substrate length.

Figure 6:
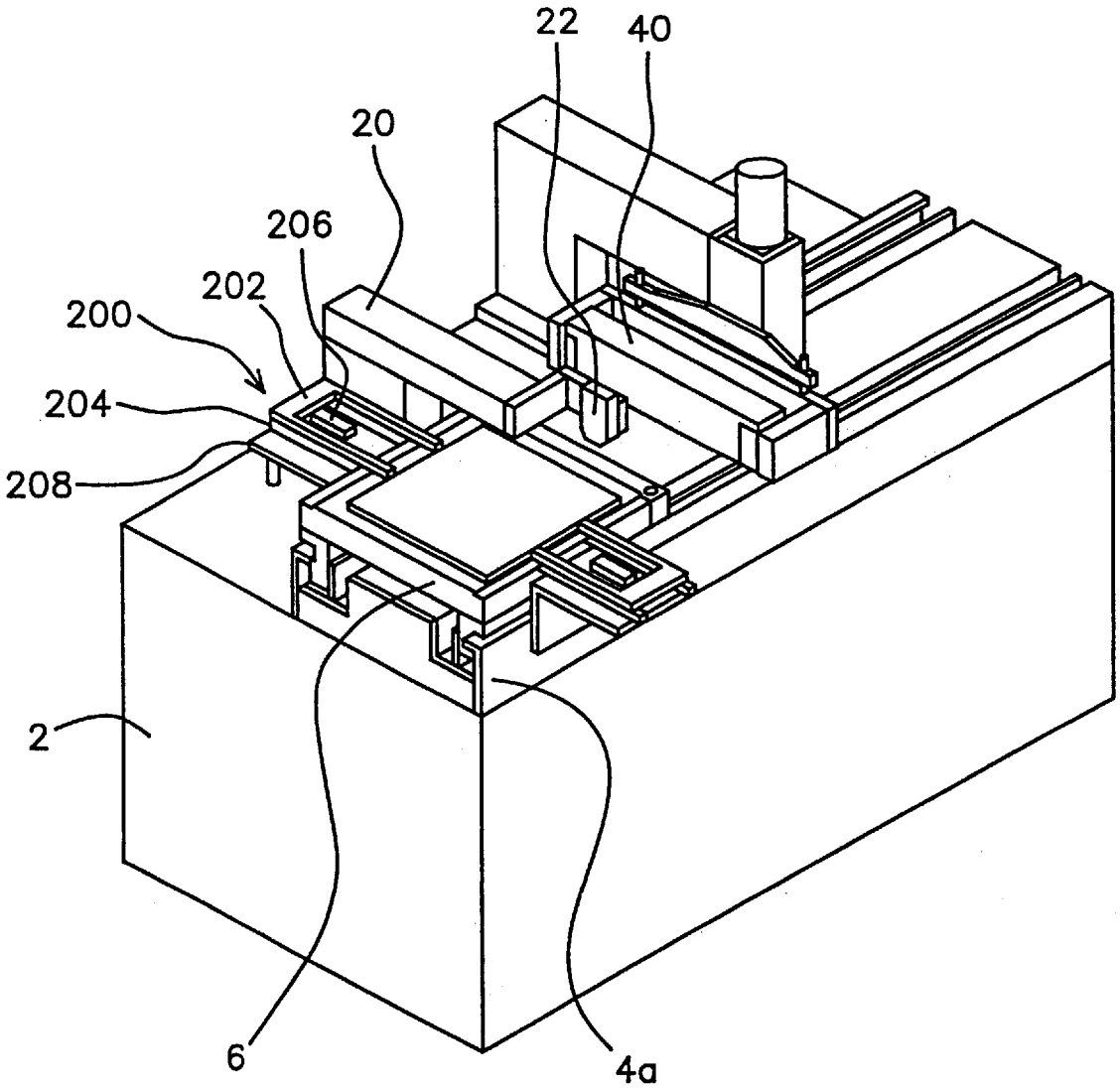
FIG. 6 shows an isometric projection of another die coater embodiment.

FIG. 6 shows another practical embodiment of the coating apparatus shown in FIG. 2.

In this embodiment, a pair of widthwise positioners 200 which determine the widthwise position of the substrate A are added. Each widthwise positioner 200 which is placed at each lateral side of the substrate A comprises a positioning pusher 202 made of a resin etc. which is pressed against one of the edge surfaces of the glass substrate, a guide 204 which guides the positioning pusher 202 bi-directionally in the widthwise direction, a stopper 206 which is capable of holding down the positioning pusher at any given position for adjustment, and a bracket 208 which supports the moving parts and connects and secures them onto the bench 2.

The positioning pusher 202 moves back and forth powered by a driving actuator, such as an air cylinder or a linear motor, not shown in the drawing. The widthwise distance between the pair of positioning pushers 202, which is adjusted by means of the stoppers 206, is preferably 0.1–2 mm greater than the width of the substrate A. Adjustment to less than 0.1 mm would be difficult, while positioning would not be effective if the difference was 2 mm or greater. The elimination of the gap between the substrate to be coated and the positioning pusher is preferably avoided, since it would subject the substrate to abnormal forces, unless a mechanism which absorbs these forces is added or an elastic material is used for the positioning pushers.

Using a loader, the substrate A is transferred from the previous process and loaded onto the table 6 at its initial position, where the entire widthwise positioner assembly is arranged in such a way that the pair of the positioning pushers 202 are placed roughly symmetrically with respect to a datum line chosen to coincide with the center line in the traveling direction at the loading location (for example, the center line of the discharge outlet 66 of the die 40). It is highly preferable that the positioning error for this be limited to within ±1 mm. Otherwise, the intended coating area on the substrate A would be shifted greatly, and the widthwise coating thickness profile within the intended coating area would be uneven.

Here the thickness sensor 22 is shifted towards the die 40, along with its associated L-shaped sensor support 20 etc., from the position as shown in FIG. 2, to prevent it from interfering with a loader and the substrate A to be coated when the substrate A is loaded onto the table.

In the embodiment shown in FIG. 6, a thickness sensor 22 is located at a position where the thickness of the substrate A around its center can be measured when the substrate A comes to a stop with the beginning of its coating area lying just below the discharge outlet of the die 40. Since the substrate A is not raised or lowered at this position, the distance between the thickness sensor 22 and the substrate A can be fixed to a value most suitable for measurement, and a lifting mechanism for the thickness sensor 22 is not necessary.

The coating method which utilizes this coating apparatus will now be explained.

Upon resetting all the moving parts of the coating apparatus, the table 6 and die 40 move to their respective standby positions. By this time, the coating liquid supply system, from the coating liquid tank 50 to the die 40, is already filled with coating liquid, with the so-called air purge operation also completed in which any air remaining in the die is discharged by turning the die over and discharging the coating liquid upwards. The lift pins are raised from the surface of the table 6, not shown in the drawing, and stand by to receive a substrate to be coated from the loader not shown in the drawing.

The substrate A is then loaded onto the top of the lift pins from the loader. This loading position is just above the predetermined position on the table 6 for loading, and the loading is carried out within a positioning accuracy of ±1 mm in the traveling direction. This uniquely defines the relative geometrical relationship between, substrate A and the table in their traveling direction. As a result, moving the start-of-coating line on the substrate A right under the discharge outlet of the die 40 becomes synonymous with moving the table 6 into its corresponding position, and this makes it possible to carry out the position control accurately, based on outputs of the encoder secured to the feed screw 14 or table position sensor, without directly measuring position of the substrate.

The substrate A on the lift pins is then placed onto the top surface of the table by lowering the lift pins, and is sandwiched, from both sides widthwise, by a pair of positioning pushers 202, thus limiting the widthwise positioning error from the intended coating area on the substrate A relative to the widthwise position of the discharge outlet 66 of the die 40 to within ±1 mm.

In this case, too, the widthwise relative geometric relationship of the table 6 and die 40 are uniquely determined.

After the completion of sandwiching between the pair of positioning pushers 202, the substrate to be coated is immobilized via suction, while the positioning pushers 202 are moved away outwards. When the returning of positioning pushers 202 to its initial position is detected by position sensors, not shown in the drawing, the table 6 is stopped after being moved to a position which is predetermined based on its relative geometrical relationship with the substrate, and this ensures that the start-of-coating line on the substrate mounted on the table is placed right under the discharge outlet of the die 40 with a positioning accuracy of within ±1 mm, preferably ±0.5 mm. While at rest, the thickness of the substrate A is measured using the thickness sensor 22. Based on this thickness and a predetermined clearance, the required value for a descent of the die 40 in terms of the reading on the linear sensor is calculated, and then the die is controlled so as to move to the calculated position, ensuring that the die 40 descends to the position calculated above on the linear sensor, with the clearance between the substrate to be coated and the die set accurately.

By this time, the syringe pump 44 has finished drawing a predetermined amount of coating liquid from the coating liquid tank, and, after ensuring of the establishment of the clearance, coating liquid is supplied to the die 40 from the syringe pump. As soon as the syringe pump is activated, the timer inside the computer 54 is started, and, after a predetermined period of time, a starting signal is sent to the sequencer 56 from the computer. The table 6 then starts moving at the coating speed, and coating begins.

Since the substrate A is always mounted in the same predetermined place on the table 6, it is possible to set the position sensors or the reading of its associated encoder to the position of the table 6 corresponding to (a) 5 mm before the end of the intended coating area or (b) the end of the intended coating area on the substrate in the traveling direction. When the table 6 comes to a position corresponding to (a), a stop signal is sent by the computer 54 to the syringe pump 44 to operate squeegee coating until reaching the position (b), and as soon as reaching to the position (b), the computer 54 sends a signal to raise the die 40, which leads to raise the die 40, thus disconnecting the coating liquid bead completely.

While these operations are taking place, the table 6 continues moving, but finally stops when it reaches a terminal position where the substrate A to be coated is transferred using an unloader. Then the immobilization by suction of the substrate A is disabled, and the substrate A is raised by lifting the lift pins.

The substrate A is then secured from below by an unloader, not shown in the drawing, and is handed over to the next process. After passing the substrate on to the unloader, the lift pins are lowered and the table 6 returns to its original position.

The syringe pump 44 is activated again and a small amount of coating liquid, 10 $\mu$l–500 $\mu$l, is sent to the die 40 to ensure that there are no voids between the lips of the die 40. After covering the bottom surface of the die 40 with coating liquid, any residual coating liquid remaining on the bottom surface of the die 40 is wiped off with a wiper made of silicone rubber or the like, thereby making the surface substantially even. If the bottom surface of the die is not covered with coating liquid, residual coating liquid tends to be left in isolated patches, and attempts to wipe this off with a rubber wiper tend to leave rubber dusts as a pollution source, which, in turn, give rise to coating defects.

The 10–500 $\mu$l mentioned above is a discharging volume suitable for covering the entire bottom surface, which makes the wiping operation possible to clean the bottom surface without generating rubber dusts, with the coating liquid acting as a lubricant.

After the syringe pump 44 has discharged the coating liquid to be wiped off, it is filled up with another volume of coating liquid from the tank 50 again via suction. It then stands by for a next substrate to be coated and the same operations are repeated.

In the above embodiment, when the substrate to be coated which has been passed on from the loader to the lift pins was placed onto the surface of the table 6 by lowering the lift pins, if the lift pins are retracted too fast, part of the air between the substrate and the surface of the table 6 sometimes fails to escape resulting in the substrate floating on this layer of air due to a phenomenon called the air bearing effect, and the position of the substrate could shift greatly in the traveling direction from the predetermined position.

For this reason, the surface of the table 6 is preferably subjected to vacuum suction through the suction holes of the substrate at −50 to −300 mmHg before the lowering of the lift pins. If the lift pins are lowered under this condition, the air between the substrate and the surface of the table 6 is removed effectively irrespective of the lowering speed of the lift pins, which prevents the substrate from moving on the surface of the table 6, leading to accurate positioning of the substrate at the predetermined position on the table 6. If the above suction pressure is less than −50 mmHg, it will have no air removal effect, while, if it is greater than −300 mmHg, the suction pressure will be too high for the substrate and difficult to move the substrate widthwise to the predetermined position when activating the widthwise positioner.

Improvements on the ±1 mm positioning accuracy, e.g. to not more than ±0.5 mm, can easily be achieved widthwise by improving the accuracy of the setting of the widthwise distance between the pair of the positioning pushers 202 of the widthwise positioner. However, in the traveling direction, it is difficult to always guarantee a ±0.5 mm accuracy, as the transfer of the substrate from the lift pins to the surface of the table 6 is vulnerable to disturbance, even where its transfer from the loader to the lift pins can be carried out with this accuracy.

Therefore, to achieve this accuracy in the traveling direction, it is necessary to undertake positioning in this direction after placing the substrate onto the surface of the table 6, as in the case of the width direction.

Figure 7:
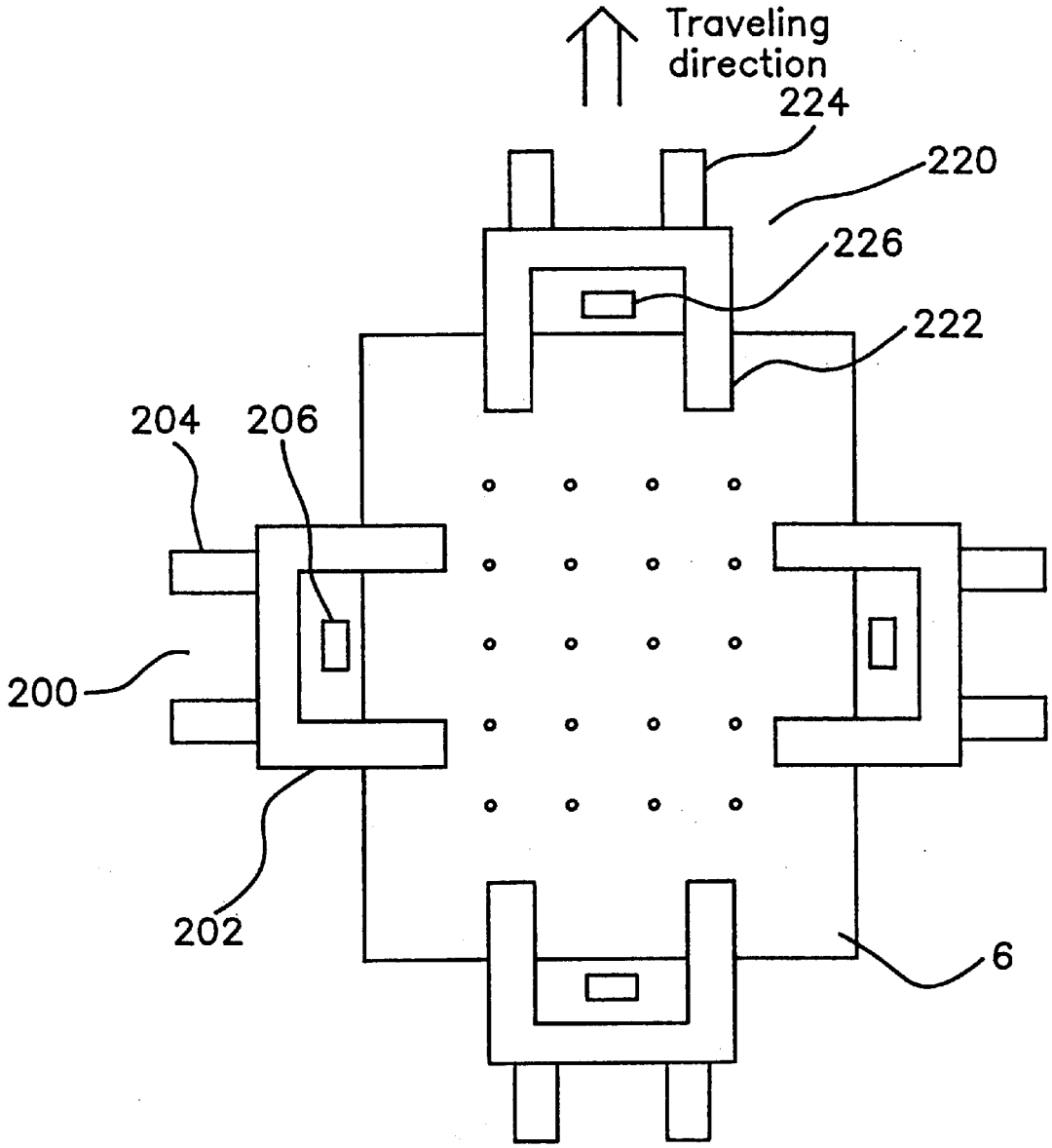
FIG. 7 shows a plan view of a positioning device embodiment.
Figure 8:
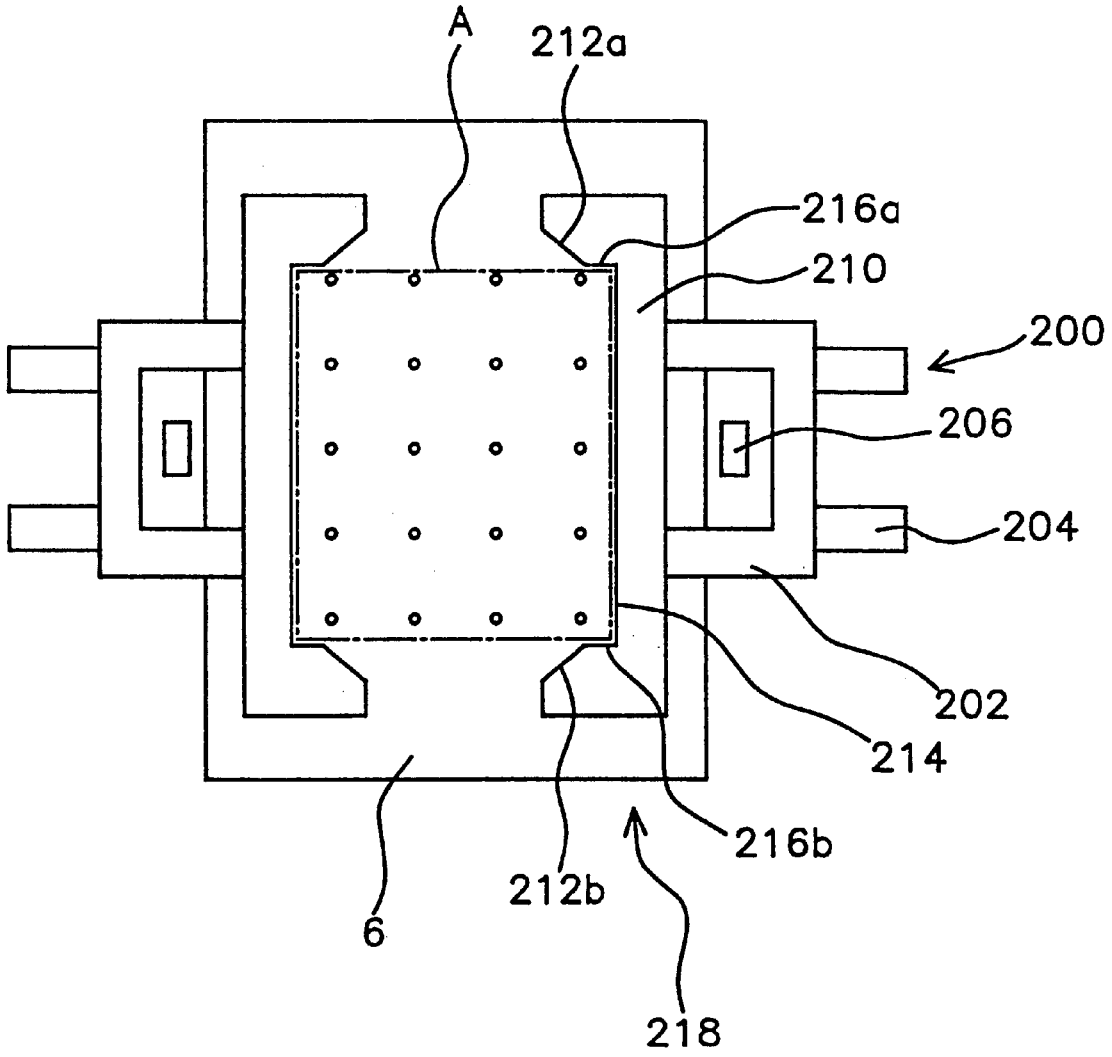
FIG. 8 shows a plan view of another positioning device embodiment.

FIGS. 7 and 8 show such embodiment examples. FIG. 7 is a plan view looking down at the table 6 from above, and shows the relative positions of a traveling direction positioners 220 and the widthwise positioners 200.

The traveling direction positioners 220 are the ones which comprise a pair of the widthwise positioners 200 secured to the table, but are in such a way that they sandwich the substrate in the traveling direction. Like the widthwise positioner 200, each traveling direction positioner 220 comprises a positioning pusher 222, a guide 224 which guides the positioning pusher 222 in the traveling direction, a stopper 226 which is capable of holding down the positioning pusher at any given position for adjustment, a bracket which, not shown in the drawing, secures the units mentioned above onto the edge faces of the table 6, and a driving actuator which, not shown on the drawing, moves the positioning pusher 222 in the traveling direction reciprocally.

As shown in FIG. 7, the traveling direction positioners 220 are placed in front of and behind the table 6 and they are arranged in such a manner that they sandwich the substrate in the traveling direction, leaving a gap of 0.1–1 mm. Further, it is possible to place the substrate in a predetermined position on the table 6 with an accuracy of ±0.5 mm, by arranging and adjusting the pair of the traveling direction positioners 220 and the substrate in such a manner that they are placed approximately symmetrically with respect to a line drawn at the center of the loading position in the widthwise direction.

Regarding positioning order, the traveling direction and the widthwise direction positioning may be undertaken simultaneously, or one of them is performed first, followed by the other operation.

FIG. 8 is a plan view looking down at the table 6 of another embodiment.

In this embodiment, an adjustment piece 210 made of a resin is attached to the tip of the positioning pusher of the widthwise positioner 200. The adjustment piece 210 is designed so that the distance between the transverse sides 216*a* and 216*b* is greater than the length of the substrate in the traveling direction by 0.1 mm–1 mm, while the distance between the pair of longitudinal sides 214 of the adjustment piece which sandwich the substrate in the widthwise direction, is greater than the length of the substrate in the width direction by 0.1–1 mm by adjusting the stopper 206.

The entire widthwise positioner 200 assembly is arranged and adjusted in such a manner that, when the substrate A to be coated is sandwiched by the pair of adjustment pieces 210, the deviation in the position of the substrate on the table 6 from the predetermined position is within ±0.5 mm.

If this positioning device 218 is activated after the substrate to be coated has been transferred from the top of the lift pins onto the surface of the table 6, the edges of the substrate to be coated come in contact with sloped sides 212 of the adjustment pieces 210 as the pair of adjustment pieces 210 moves towards the center, and the substrate to be coated moves into the final position with its edges sliding against the sloped sides as a guide, which finally leads to positioning of the substrate with a margin determined by the gaps made by transverse sides 216*a* and 216*b* and longitudinal sides 214.

The preferable inclination of the sloped sides is in a range of 5°–45° with respect to the transverse sides. If the inclination is less than this range, the sloped side will become too long, increasing the size of the device, and if it is greater than this range, the substrate to be coated fails to slide the slop sides and gets stuck, spoiling the guiding effect of the slope. Also, if adjustment pieces 210 of various dimensions in terms of the lengths of the transverse sides 216*a* and 216*b* are prepared in advance and made readily interchangeable, they could be easily applied to different sizes of substrates.

This embodiment makes it possible to simultaneously carry out the positioning of the substrate on the table 6, both in the widthwise and traveling directions, with a high accuracy with less components than the embodiment shown in FIG. 7. Alternatively, the positioning device 218 may be fixed at the position which the substrate to be coated will be sandwiched between them before the substrate on the lift pins is lowered onto the table 6.

Figure 9:
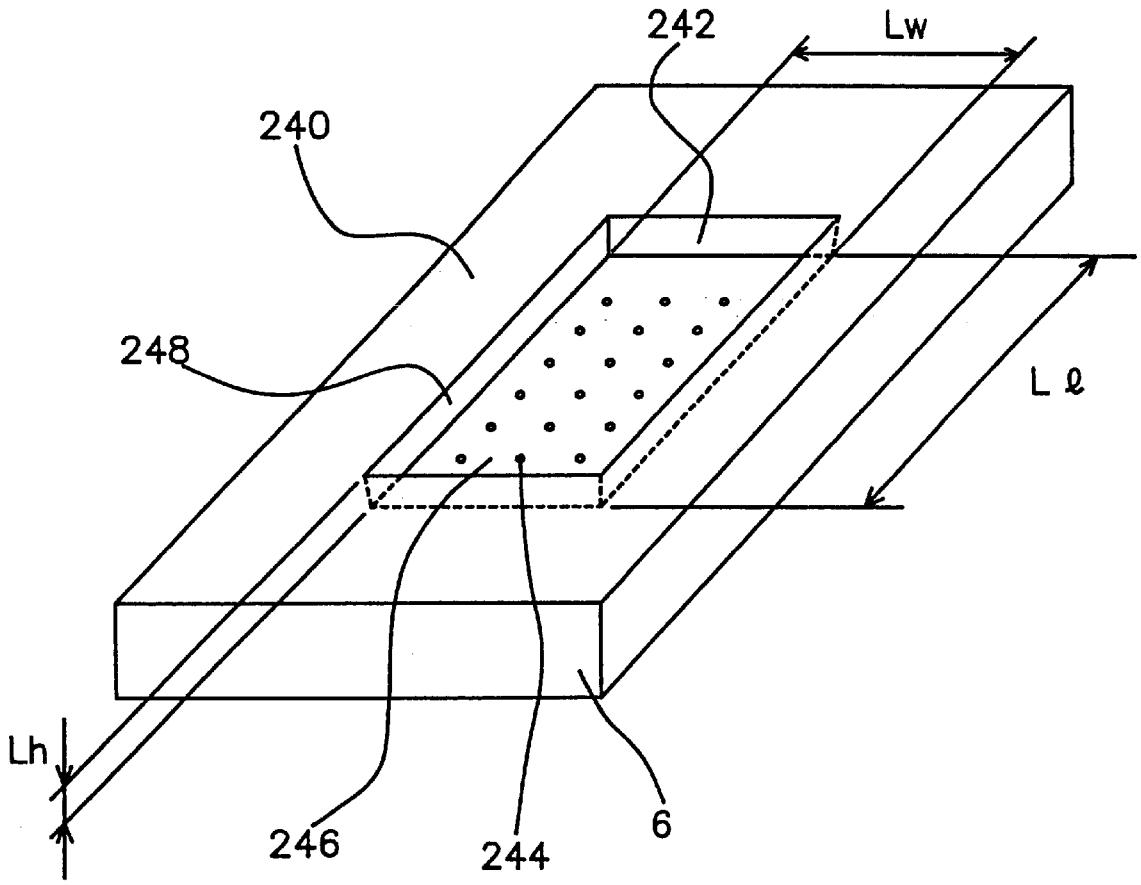
FIG. 9 shows an isometric projection of a still another positioning device embodiment.

FIG. 9 shows still another embodiment, in which a rectangular depression 240 is provided in a predetermined position in the surface of the table 6. At the base of the depression, suction holes 244 and four lift pins (not shown in the drawing) are provided, and the width $L_w$ and the length in the traveling direction Ll of the bottom of the groove are greater than the corresponding dimensions of the substrate by about 0.1–1 mm. The depth Lh of the depression 240 is made equal to or less than the thickness of the substrate to be coated. The widthwise length and traveling direction length of the depression 240 increase gradually from the base 246 of the depression 240 to the surface of the table 6, making slopes 242 and 248. These slopes function as a guide when lowering the substrate on the lift pins, and the eventual positioning accuracy is determined by the gap between the substrate and bottom 246 of the groove.

While in the embodiments mentioned above, the total length of the pressing portion of the positioning pusher 202 may be either longer or shorter than the length of the corresponding side of the substrate to be coated, it is preferrable to press positions closer to the four corners of the substrate A resulting in the smaller skew of the substrate with the same gap setting. When the degree of this skew is great, the substrate to be coated is placed obliquely with respect to the discharge outlet of the die 40, and, in extreme cases, the beginning of the coated area becomes an oblique line on the substrate.

While the thickness sensor 22 is placed at a point sufficiently remote from the substrate loading location in the traveling direction to avoid interference which may occur during the loading of substrate onto the table 6 in the above description, it is possible to locate the thickness sensor 22 upwards, which could eliminate such interference, even if this configuration is done at the substrate loading portion. In this case, the thickness sensor 22 is moved by means of a lifting mechanism, and is lowered when a measurement is to be made. Therefore, the thickness of the substrate can be measured freely, no matter whether the substrate is on the loader, lift pins or the surface of the table 6. In particular, if a measurement of the thickness of the substrate to be coated can be made while the substrate is on the loader, the thickness of the substrate to be coated can be measured independent of the movement of the table 6, thus contributing to a reduction in cycle time and improvement in productivity.

Figure 10:
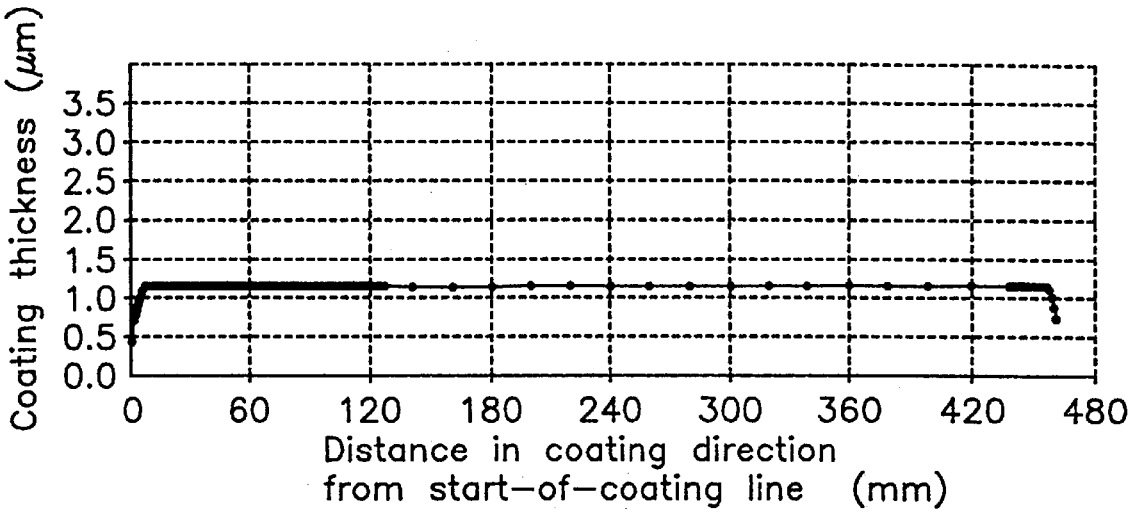
FIG. 10 shows a thickness profile of a coating in the traveling direction in a case where the positioning has been performed.
Figure 11:
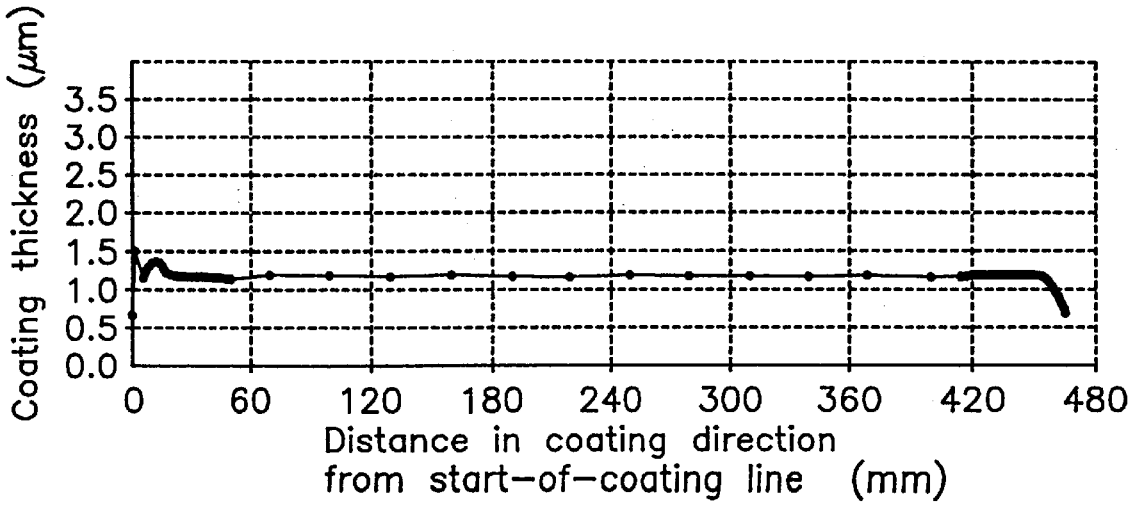
FIG. 11 shows a thickness profile of a coating in the traveling direction in a case where the positioning has not been performed.
Figure 12:
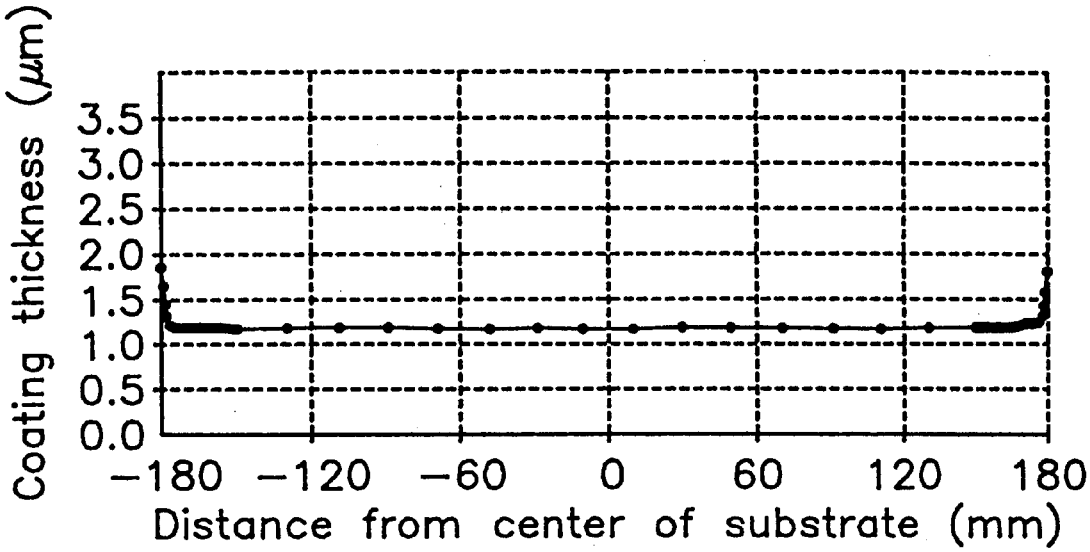
FIG. 12 shows a thickness profile of a coating in the width direction in a case where the positioning has been performed.
Figure 13:
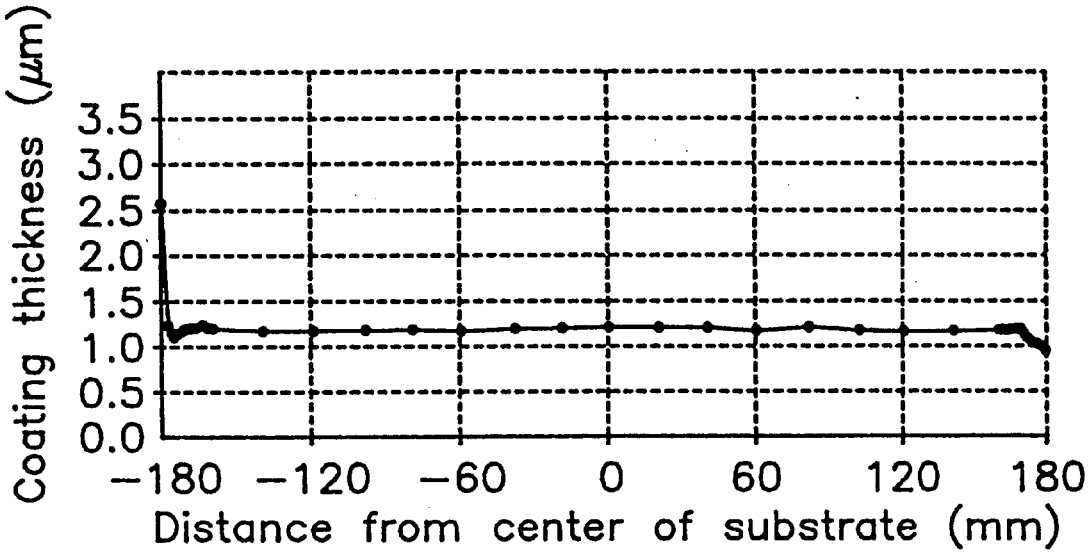
FIG. 13 shows a thickness profile of a coating in the width direction in a case where the positioning has not been performed.

In an attempt, coating was performed under the coating conditions of Example 1 given below, except that the entire surface of a glass substrate was coated, with the syringe pump stopped 5 mm before the end of the coating area, and that squeegee coating was carried out by keeping the table moving until it reached the transferring position where an unloader is provided. FIGS. 10 and 12 are coating thickness profiles in the traveling and width directions of the table 6 respectively, with positioning performed. FIGS. 11 and 13 are coating thickness profiles in the traveling and width directions of the table 6 respectively, without positioning performed. When positioning was not performed, there were deviations of 1.5 mm in the traveling direction and 2 mm in the width direction from the reference point, while they both ended up to 0.2 mm when positioning was carried out.

With positioning performed, coating thickness profiles shown in FIGS. 10 and 12 can be consistently obtained with 100 substrates, while, without positioning, fluctuation in coating thickness profiles increases as the number of substrates increases. The largest fluctuation examples are shown in FIGS. 11 and 13, which exhibit the tendency that, when the coating is thick at one end of the coating area, it will be thin at the other end, with the usable coating area reduced in which coating thickness is uniform.

Apart from a shift in the coating area, omission of positioning tends to have adverse effects on the coating thickness profile within the coating area, reducing the stability and reproducibility in coating accuracy.

Incidentally, coating apparatus to produce a coating D on a substrate A has a die 40 with a shape as shown in FIG. 3, so that it can produce a uniform coating D and is suitable for manufacturing coated sheet products such as color filters. Namely, with the die 40, the length $L_R$ of the bottom surface 74 of the lip 60 is preferably longer than the length $L_F$ of the bottom surface 70 of the front lip 58, as this ensures that the boundary line E of the coating liquid bead C (see FIG. 3) is maintained at the bottom surface 70. This prevents fluctuations in the shape of the coating liquid bead C during the formation of the coating D, and makes the coating D uniform. With this type of die, the length $L_F$ of the bottom surface 70 is preferably 0.01 mm or larger and 0.5 mm or smaller. If the length $L_F$ is 0.5 mm or less, it can certainly prevent the border line E of the coating liquid bead C from going over the edge of the bottom surface 70 due to surface tension and flowing up to the front of the front lip 58. In order to reduce the likelihood of the border line E of the coating liquid bead C flowing up to the sloped surface 68, the angle $\theta_F$ made by the sloped surface 68 which connects to the bottom surface 70 and a horizontal plane is preferably 30° or greater, while, to maintain the stiffness of the bottom portion of the front lip 58, this angle $\theta_F$ due to the sloped surface 68 is preferably 60° or smaller.

If the border line E of the coating liquid bead C flows up to the front of the front lip 58, it is impossible to keep the coating D thin. The length $L_F$ of the bottom surface of the front lip 58 is preferably at least 0.01 mm. If it is close to zero, i.e. the bottom of the lip being a knife-edge, it will be difficult to maintain its stiffness and keep it on the same plane as that containing the bottom surface of the rear lip 60 in the direction of the width.

If the bottom surface 70 of the front lip 58 and bottom surface 74 of the rear lip 60 lie on the same horizontal plane, the two border lines associated with them which define the upper end of the coating liquid bead C can be stably maintained, and the shape of coating liquid bead C will not become unstable.

The bottom surface 74 of the rear lip 60 is preferably 1 mm or greater and 4 mm or smaller, as this will ensure the formation of a coating liquid bead between the bottom surface 74 and the substrate A to be coated. If the $L_R$ is smaller than 1 mm, the bead formation effect will be insufficient, while, if it is greater than 4 mm, the size of the bead will not increase further, so that there will not be much advantage.

While a die of the embodiment described above is most suitable for the production of a coating on sheet substrates such as glass sheets, it is also applicable to continuous application of coating liquid on long sheet substrates and coating on continuous substrates. Also, in the above embodiment, the die is placed face down, but, even if it is placed on its side or face up, uniform coatings can be produced on substrates in the same manner.

While the preceding die embodiments represent the preferred ones, coating apparatus according to the present invention will also prove quite effective with other types of dies.

Coating accuracy will increase as the clearance $L_C$ between the die 40 and the substrate A to be coated becomes more uniform in the direction of the length of the die.

Figure 14:
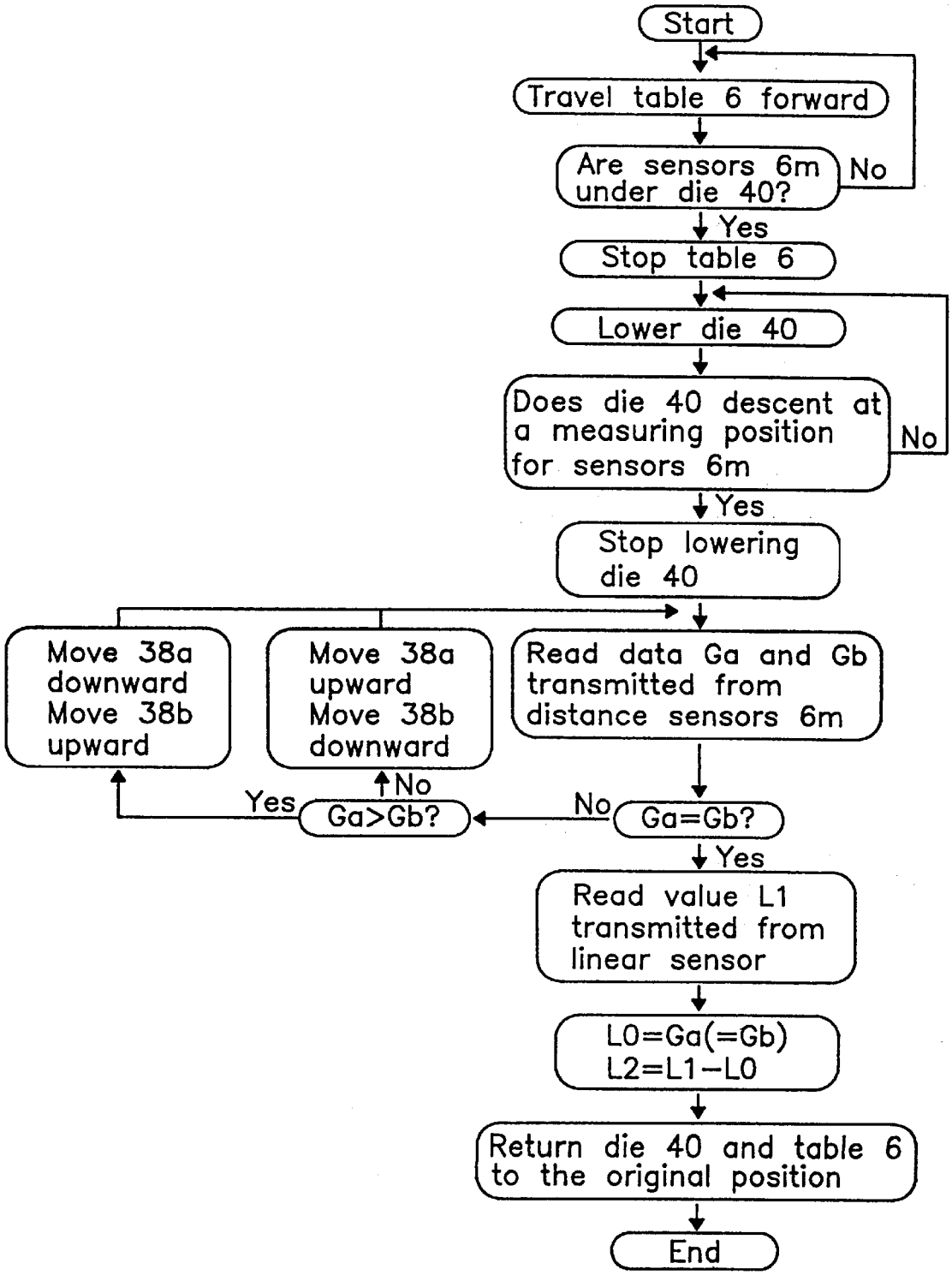
FIG. 14 shows a flowchart of the parallelism adjustment process.

Adjustment of the clearance is undertaken during the preparatory step before coating, rather than during coating. The adjustment procedure will now be explained with reference to the flowchart shown in FIG. 14.

Firstly, prior to the beginning of a continuous coating operation (e.g. immediately after the completion of the assembly of coating apparatus, replacement of the die 40 or the like), the table 6 in FIG. 2 is moved to bring the pair of distance sensors 6*m* attached to it to a position directly below the die 40, and stopped. After the die 40 is lowered to the measurement position and stopped, the distances Ga and Gb which are defined as length between each distance sensors and predetermined positions on the bottom surface of the die 40 are measured by the pair of distance sensors 6*m*. When the two distances differ, adjustments are made to bring them in line by allowing the die 40 to be rotated by means of adjustment actuators 38*a* and 38*b* which correspond to Ga and Gb respectively. More specifically, if Ga>Gb, the extensible rod of the adjustment actuator 38*a* is moved downwards, and that of the adjustment actuator 38*b* is moved upwards. If Ga<Gb, the opposite operations are performed. In this manner, the bottom surface 70 of the die 40 is brought into parallel position with respect to the top surface of the table 6. The distance measurement reading Ga or Gb when parallelism is achieved is relabeled as L0. The reading of the linear sensor for the die holder 32 which measures its travel distance associated with the lifting and lowering of the die 40 is labeled as L1. Then, from L0 and L1, the expected linear sensor reading when the bottom surface 70 of the die 40 comes right on the top surface of the table 6, labeled as L2, is calculated. Based on L2, the expected linear sensor reading for the position of the die 40 during coating, labeled L3, is calculated, taking into account the thickness of the substrate and clearance. With a calculation means which carries out these calculations, along with a control means which actually moves the die 40 down to the point corresponding to the linear sensor reading L3, the clearance can be set accurately for dies of any dimensions. Namely, if the shape of the die as well as the distance from the die holder 32 to the bottom surface of the die 40 changes, the parallelism between the die and the table can be accurately adjusted, while the clearance can be set accurately according to the glass substrate to be coated.

Although, in the above embodiment, parallelism is adjusted after halting the downward movement of the die and measuring the distances Ga and Gb, such adjustment may be undertaken simultaneously with the measurement of Ga and Gb while the die is being lowered.

While improvements in the accuracy of the clearance in the traveling direction increase the accuracy and stability of the coating, an embodiment according to the present invention has roller bearings as a linear slider which shoulder the table 6 and guide its movement as part of the linear slider.

Figure 15:
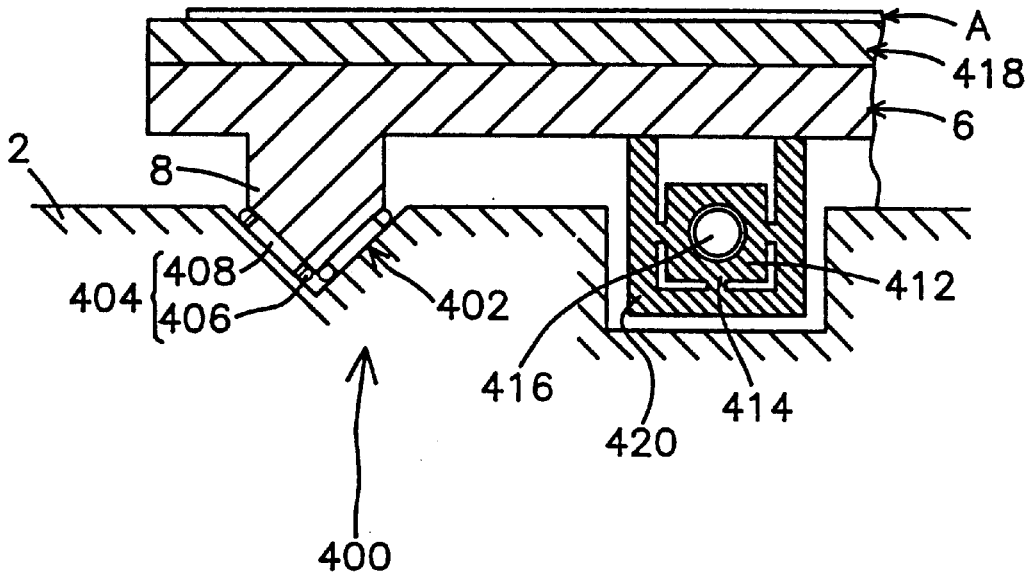
FIG. 15 shows a detailed enlarged sectional view of the linear slider.

Namely, the above linear slider 400 comprises a pair of V-shaped grooves 402 provided on the top surface of the bench 2, V-shaped roller bearings 404 housed in the V-shaped grooves 402, a table 6 with its stems 8 shouldered by the roller bearings 404, a ball screw nut 412 provided in a predetermined position on the bottom surface of the table 6, and ball screw 416 which, turned by a driving motor 18, engages with the above ball screw nut 412, as shown in FIG. 15 illustrating enlarged images of the main components. The above ball screw nut 412 is coupled to a ball screw support 420 which is coupled to the table 6 via a coupler 414 which is provided only locally and has elasticity to allow an elastic support of the ball screw nut 412. The above table 6 has a suction plate 418 on its top surface.

The above roller bearings 404 is composed of a retainer 406 formed into a V shape and two or more rollers 408 which are secured onto each face of the retainer 406 in such a way that they are allowed to rotate freely.

Figure 16:
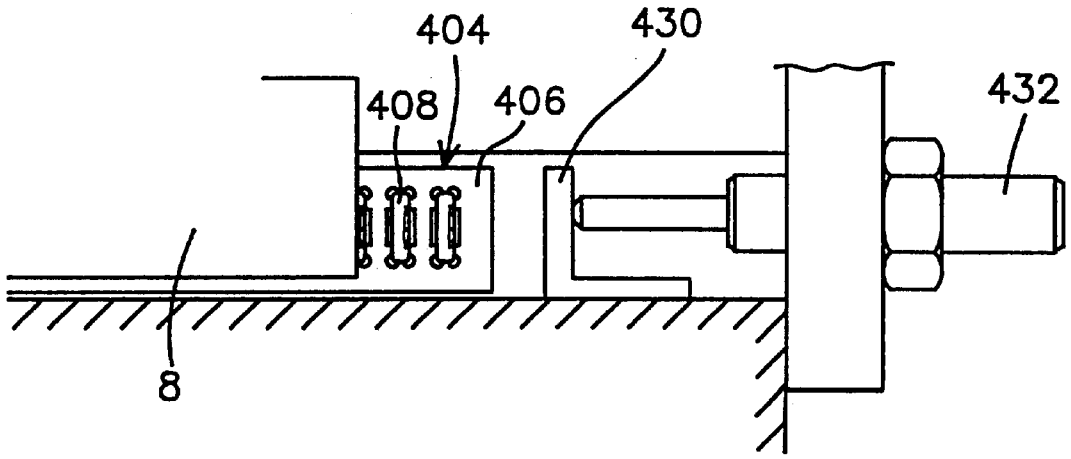
FIG. 16 shows a diagram of the configuration of the portion for blocking the movement of the roller bearing.

Furthermore, roller bearing stops 430 which are provided at predetermined positions near the limits of the movement of roller bearings 404 associated with the low speed travel of the table 6 and which engage the retainer 406 to block forcibly the movement of roller bearings 404, are provided, along with a shock absorber 432 which softly pushes the roller bearing stops 430, as is shown in detail in FIG. 16.

Therefore, since the ball screw 416 and the ball screw nut 412 are engaged, the table 6 can be moved at a predetermined speed by turning on the driving motor 18 after setting the vertical position of the die 40, with the substrate A to be coated retained by the suction plate 418. In this case, as roller bearings 404 stand between the sliding stem 8 and the V-shaped groove 402, the smooth and high speed movement of the table 6 can be achieved. While the table 6 would normally develop a fairly large fluctuation in vertical position due to pitching and yawing as a result of fluctuations in the diameters of the rollers 408 which constitue the roller bearings 404, this can be limited to within ±1 μm or sub-micron range, since each roller 408 performs only a rotating motion, unlike a linear motion guide which rotates and revolves simultaneously.

Consequently, the fluctuation in the gap between the top face of the suction plate 418 and the die 40 can be limited to within ±1 μm or sub-micron range.

Therefore, a coating with only a small fluctuation in thickness can be produced on the substrate A by starting the discharge of a coating compound via the die 40 when the edge of the substrate A comes right below the die 40.

In particular, when producing a thin-film coating using a low viscosity coating compound, e.g. using a Newtonian liquid of 30–50 centipoise in viscosity as a color filter coating liquid, the gap between the die 40 and the glass substrate must inevitability be small, for example 100 μm or less, more preferably 50 μm or less. As a result, it is also necessary to improve the dispersion in the gap, for example to ±3 μm or less. While linear sliders based on conventional linear motion guides cannot cope with such strict demands, those using a linear slider described in this embodiment certainly can.

When coating on glass sheet substrates using a die coater of this embodiment, it is necessary to increase the traveling speed of the table 6 so as to increase productivity. In this respect, too, this embodiment is superior in that it can achieve considerably high traveling speeds (e.g. 10 m/min or more), significantly greater than 1–2 m/min which is possible with a linear motion guide featuring high traveling accuracy sliding bearings. Its accuracy is also excellent, with a high traveling accuracy, not possible at all with a linear motion guide, and a resulting high coating accuracy achieved.

Moreover, when coating on glass sheet substrates, it is more common to set the backward traveling speed of the glass substrates higher during their return travel than their forward traveling speed during the application of a coating liquid. This gives rise to slipping of roller bearings 404 and their shifting to one end due to a great difference in traveling speed between the forward and backward travel. However, since the shifting of the roller bearings 404 are blocked by roller bearing stops 430, the function of the roller bearings 404 can be maintained, ensuring the long stable and smooth bi-directional movement of the table 6.

Figure 17:
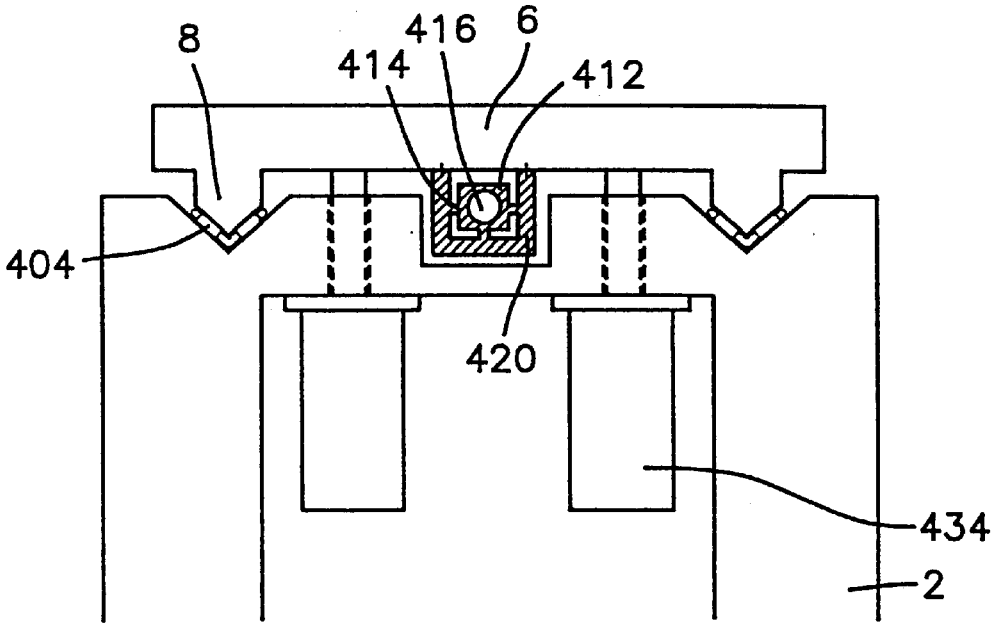
FIG. 17 shows a diagram of the configuration of the portion for lifting the table.
Figure 18:
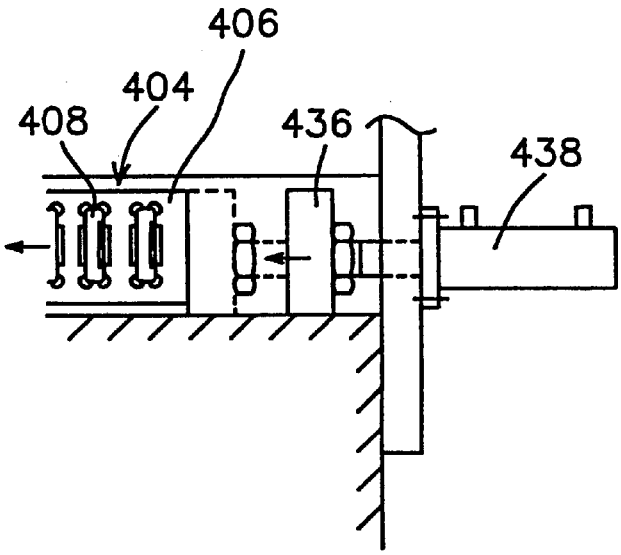
FIG. 18 shows a diagram of the configuration of the portion for moving the roller bearing backwards.

In place of or in addition to the configuration shown in FIG. 16, table lifting cylinders 434 designed to raise the table 6 after a predetermined number of two-way travels of the table 6 (which correspond to a number of shifting in the position of roller bearings 404 to the movement limit point or its vicinity) and roller bearing repositioning cylinders 438 designed to return the roller bearings 404 to a predetermined position in response to the lifting of the table 6 by the table lifting cylinders 434, as shown in FIGS. 17 and 18, may be introduced to deal with the problem of roller bearings 404 shifting to one end due to slipping.

Figure 19:
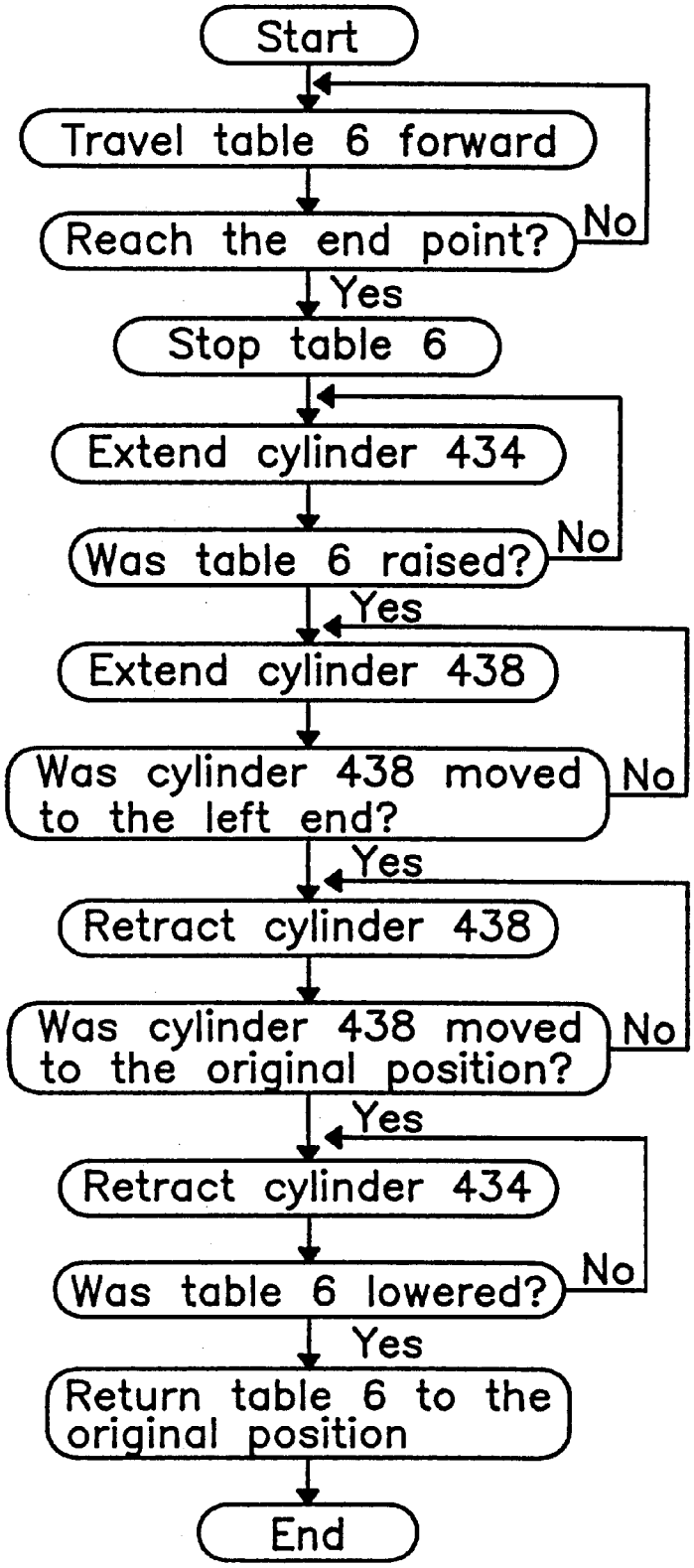
FIG. 19 shows a flowchart of the roller bearing's backward movement process carried out by the devices given in FIGS. 17 and 18.

The procedure to return the roller bearings is as shown in the flowchart in FIG. 19. Namely, the table 6 is moved to the end point of the forward travel, where the table lifting cylinders 434 and roller bearing returning cylinders 438 are provided, and stopped. Then the table 6 is lifted by the table lifting cylinders 434, and, with the load on the roller bearings thus removed, the roller bearing repositioning cylinders 438 are extended to push back the roller bearings. Finally, the cylinders 438 and 434 are retracted one by one and the table 6 is placed on the roller bearings 404.

In this regard, the length over which the roller bearings 404 are pushed back is preferably equal to the length required to return the roller bearing 404 to the original position. The number of two-way travels of the table 6 can easily be informed by the sheet substrate coating control unit (not shown in the drawing), as it is the same as the number of executions of the sheet coating process. Moreover, the part 436 is an engagement member which engages the retainer 406 and is driven by the cylinder 438.

To push back the roller bearings 404 by means of cylinders 438, the table 6 may be raised slightly (e.g. 0.1–1.0 mm) by a cylinder 434. When raising the table 6, the elastic deformation of the coupler 414 can prevent the ball screw 416, ball screw nut 412 and ball screw bearings from being subjected to unnecessarily large forces, which prevents degradation in the accuracy of the ball screw mechanism.

Similar effects can be achieved, if a rectangular groove is adopted instead of a V-shaped groove 402, along with rectangular stems 8 and roller bearings 404 featuring flat retainers 406, although up and down movement and yawing increase. Similar effects can also be achieved by inserting an elastic plate made of a substrate such as rubber at the joint with table 6, in place of the coupler 414.

The quality of coated products depends not only on the means of coating but also on the comprehensive manufacturing method including the means of coating.

Figures 20A, 20B, 20C:
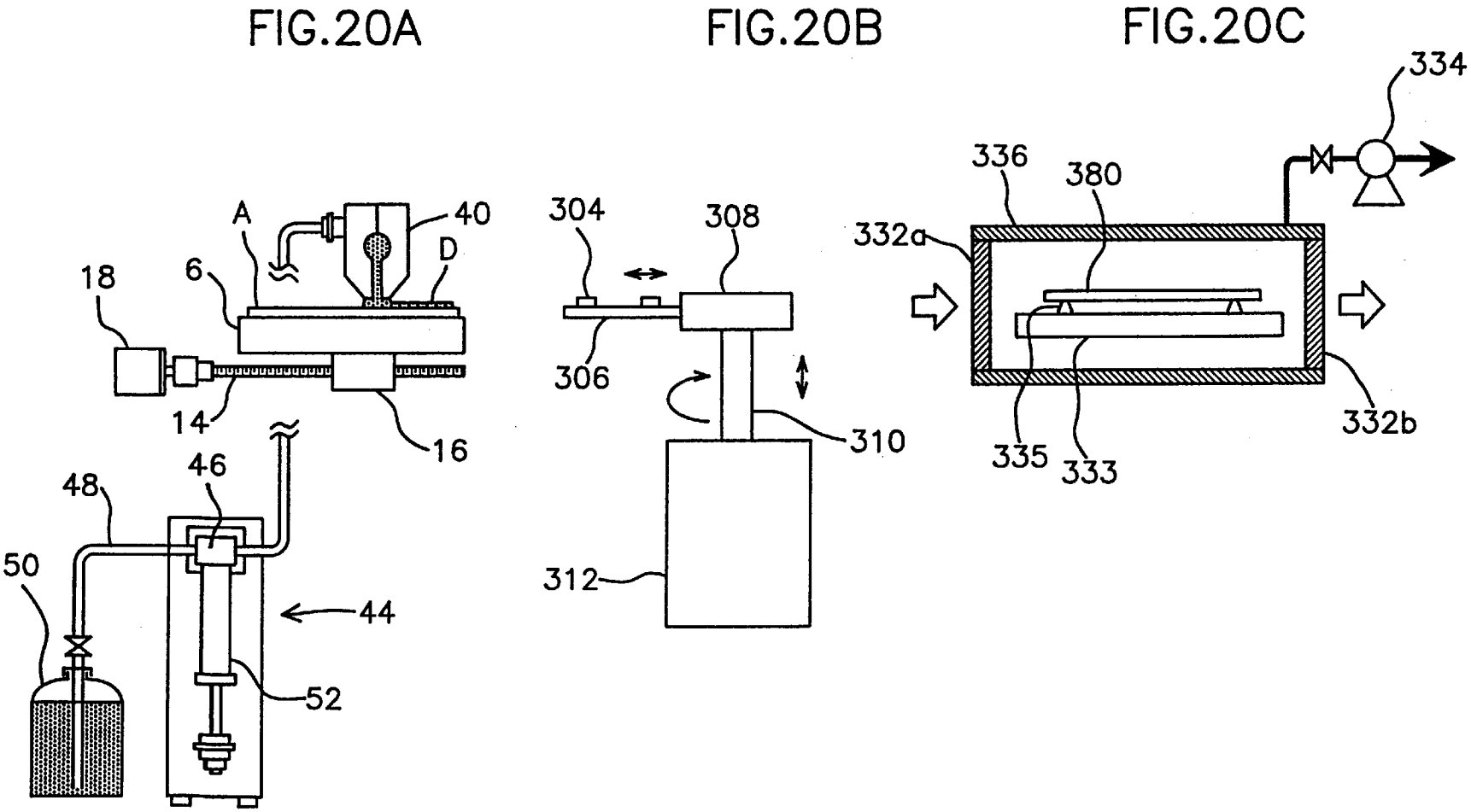
FIG. 20 shows a diagram of an embodiment of the coated sheet product manufacturing method.

An embodiment of the manufacturing method according to the present invention is shown in FIG. 20.

The apparatus used in this embodiment has a die coating unit 300 where a coating is applied on a substrate by a die 40, a substrate transfer unit 302 which transfers the coated substrate 380 to the next process after coating, and a vacuum drying unit 330 which dries the coated substrate in a vacuum. The substrate transfer unit 302 which is basically an unloader is made up of a cylindrical coordinates robot having an extendible arm 306 which is capable of up-and-down and turning motion. At the end of the extendible arm 306, two or more suction pads 304 is provided which are capable of retaining a substrate via suction.

After coating is completed in the die coating unit 300, the suction force on the coated substrate 380 is released, and the substrate 380 on which a coating D has been formed is lifted from the table 6, as the lift pins extend from the surface of the table 6.

Then, as soon as the substrate transfer unit 302 operates to allow the substrate 380 to be secured on the suction pad 304 on the arm of the unit by suction, the arm 306 rises, removing the substrate 380 from the lift pins of the table 6 to pass the substrate 380 on to the vacuum drying unit 330. In the vacuum drying unit 330, a shutter 332*a* is opened and the substrate transfer unit 302 operates to load the substrate 380 onto the proximity pins 335 on the hot plate 333. The shutter 332*a* is then closed, and vacuum drying is carried out by drawing out air from the interior via a vacuum pump 334. Heat is also applied to the substrate 380 by means of the hot plate 333. After vacuum drying is completed, a shutter 332*b* is opened, and the substrate 380 is passed on to a heat curing unit, not shown in the drawing, by a substrate transferring machine (not shown in the drawing). In the heat curing unit, the coating liquid is cured, by heating the substrate on the hot plate and keeping a predetermined temperature for a predetermined length of time, and by cooling it down on a cold plate. Heating on the hot plate is performed with the substrate 380 supported on pins.

Vacuum drying conditions include the degree of vacuum, which is preferably 20 Torr or less in absolute pressure, more preferably 5 Torr or less, still more preferably 2 Torr or less. If undertaken at a pressure greater than 20 Torr, vacuum drying will take a long time. If it is to be performed larger than 20 Torr and there are requirements to shorten the drying time to increase productivity, such requirements have to be met by raising the temperature, thereby increasing the evaporation rate. However, as the temperature increases, a viscosity of the coating liquid decreases, making the coating liquid more susceptible to disturbances. As a result, it becomes difficult to prevent defects from being caused during the vacuum drying operation. To avoid bumps of the coating liquid, the time required for the chamber interior gas pressure to reach the vicinity of the equilibrium vapor pressure of the solvent under a certain temperature condition, t1, is set within the bounds of 1 sec<t1<120 sec in the operation of the vacuum dryer. Further, the time required to reach about 1 Torr is preferably set to about 60 sec or less, as this will help achieve swift and uniform vacuum drying.

The temperature is preferably 30° C. or greater and 180° C. or less, more preferably 40° C. or greater and 150° C. or less, still more preferably 50° C. or greater and 120° C. or less. If undertaken at a temperature less than 30° C., vacuum drying will take a long time, and at greater than 180° C., an uneven temperature distribution occurs even in vacuum drying, giving rise to vulnerability to the generation of defects. In addition, a temperature more than 180° C. can cause a large decrease in viscosity of the coating liquid, making the coating liquid more fluid and susceptible to the generation of defects such as proximity pin marks.

With the die coating unit 300, a coating can be produced within a desired rectangular coating area on a substrate A, with excellent positioning and thickness accuracy. This is not possible with method using a spin coater, roll coater, etc.

When productivity is to be increased by drying and heat curing a coating flawlessly formed on a substrate over a short period of time by using an ordinary hot plate type oven, it is necessary to increase the evaporation rate by raising the temperature. However, when the temperature is increased, the viscosity of the coating liquid decreases, making it more fluid and susceptible to disturbances. Moreover, since the evaporation rate is great, the rate of suction from the oven must be increased to remove the vapors generated. The rate of airflow by convection then increases, and this disturbs the surface of the coating which has already become susceptible to turbulence, thus degrading the quality of the coating. In extreme cases, the coating liquid applied within a rectangular coating area on the substrate can start migrating from the edge of the original coated area due to violent convection and an increase of its own liquidity, resulting in an extreme degradation in the coating position and thickness accuracy.

With the above embodiment according to this invention, drying takes place in a vacuum, so that even much lower temperatures will suffice to get as the same evaporation rate as in normal pressure. Therefore, the fall in viscosity and the increase in liquidity, of the coating liquid will be small, so that disturbances in the coating surface due to the evaporation pattern, temperature fluctuations, convection, etc., can be prevented.

Namely, this embodiment of the coating method, involving coating using a die 40 and drying by vacuum dryer, can produce excellent products in terms of coating area and quality which is not possible with other types of coaters.

If a substrate positioning process as shown in FIG. 6 etc. is added to the configuration shown in FIG. 20, the positioning and thickness accuracy of the coating applied on the substrate improves further.

In this example, there is only one vacuum drying unit, but there can be more.

Usually, vacuum drying takes more time than coating, so that productivity can be improved by sending coated substrates to a number of vacuum drying units one by one as they are produced, and passing them on to the next process after the completion of drying, as this will ensure that the coating cycle time is not subjected to the vacuum drying time.

Moreover, in the vacuum drying unit 330, the suction outlet leading to the vacuum pump 334 is preferably placed at a position which is higher than that of the coated substrate 380 and does not directly face the coated surface of the substrate 380. This is particularly true when providing a suction outlet in the top plate 336. More than one suction outlets are preferably provided in a distributed manner to obtain a uniform dried film.

Usually, the chamber of the vacuum drying unit 330 is designed to have a small capacity in order to maintain a uniform temperature distribution, and the distance between the coated substrate 380 and the top plate is small.

Therefore, if a suction outlet is provided right above the coated surface of the substrate 380, temperature only in that part will differ from that in other parts of the chamber, and as a result, evaporation characteristics there will differ from those in other parts, which causes changes in the coating characteristics in the portion corresponding to the position of the suction outlet, making it impossible to obtain products with uniform quality. In extreme cases, the suction outlet leaves its shape on the coating surface.

If the suction outlet is provided in the top plate 336, but in a position not directly facing the coating surface, such defects can be prevented as variation in temperature distribution will not be caused in the coating surface.

If the suction outlet is placed in a position which is lower than that of the coated substrate 380, rising vapors will be pulled back and violent convection will become likely to take place between the coated surface 380 and the top plate 336, thereby producing surface defects due to disturbances on the coating surface.

EXAMPLES

Example 1

Coating was carried out by: using a coating liquid for a green-pigmented coating, with a solid content by weight of 8 wt % and a viscosity of 25 centipoise, prepared by mixing and dispersing chlorinated and brominated Phthalocyanine Green (C.I. Pigment Green 36) with polyamic acid, a polyimide precursor, as binder in N-methyl-2-pyrrolidone as solvent; using a non-alkali-content glass substrate OA-2 (Nippon Electric Glass Co., Ltd.), measuring 360 mm×465 mm×1.1 mm, as a substrate A to be coated; and setting a slot gap LP and a clearance LC to 100 μm and 75 μm, respectively. A syringe pump was used as a constant volume discharge able pump. A high precision stepping motor was used to drive a table 6 carrying a substrate, in conjunction with a sequencer for control. A coating liquid tank 50 was charged with the coating liquid for a pigmented coating, and a coating liquid path right up to a die 40 was filled with the coating liquid beforehand. To prevent the formation of a coating in marginal areas of the glass substrate up to 2 mm from both edges, the length of the discharge outlet at the end of the slot in widthwise direction was set to 356 mm.

After the substrate A to be coated had been fixed on the table 6 by means of vacuum suction, the substrate A to be coated was carried to a position right under the die 40 by moving the table 6, and stopped there. At that time, the arrival of the table 6 to the position right under the die 40 was detected by a proximity sensor, and, after the die 40 had been lowered to a position to obtain the predetermined clearance as described above, the discharge of the coating liquid was started at a rate of 285 μl/sec by activating the syringe pump 44. Then, after a desired coating liquid bead was formed between the die 40 and the substrate A throughout the width of the slot by maintaing the substrate at rest for just 0.5 sec, coating starts by driving the table 6 again which allows to move the substrate A relatively to the die, with a moving speed of the table 6 set to 3 m/sec. Almost immediately, the amount of coating liquid consumed in coating production equals to that supplied from the discharge outlet 66 of the die 40, establishing a steady-state coating condition in which a stable and continuous coating was produced. Similarly, proximity sensors were used to stop the operation of the syringe pump 44 and the table 6 at the end-of-coating line, while, at the same time, the coating liquid bead C formed between the substrate A and die 40 was removed by sucking back 140 μl of coating liquid via the discharge outlet 66 of the die by the reverse operation of the syringe pump 44. The die 40 was then raised away from the substrate A, and this completed the coating operation. The beginning and end of the coating line were set to be 1 mm from the lengthwise edges of the substrate. After this, the table 6 was reactivated to move the substrate to a loading position.

Figure 21:
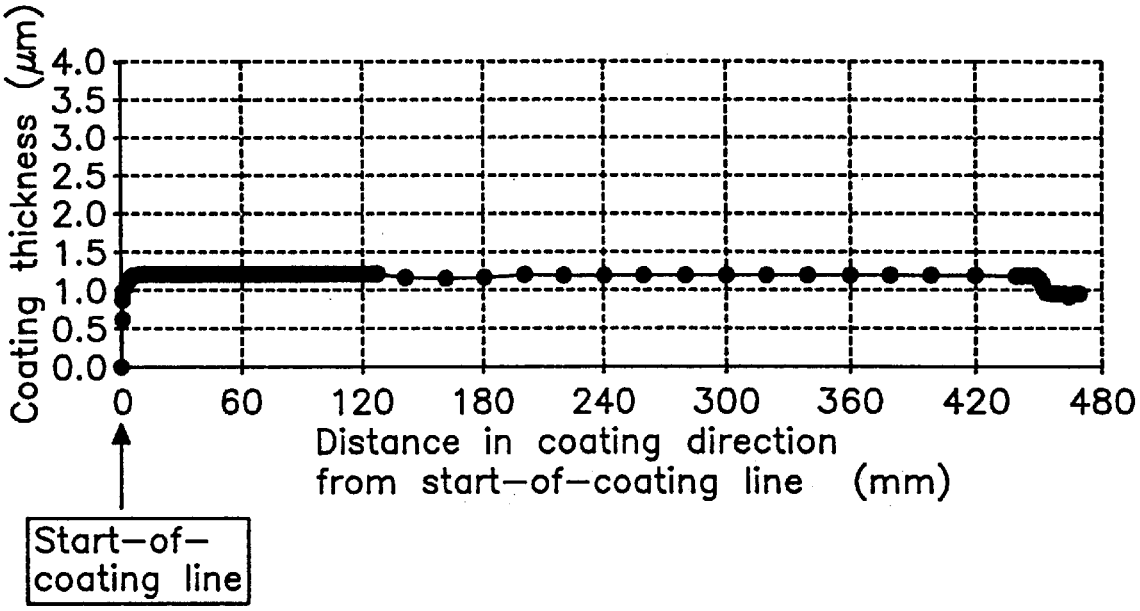
FIG. 21 shows a typical thickness profile of a coating obtained in Example 1.
Figure 22:
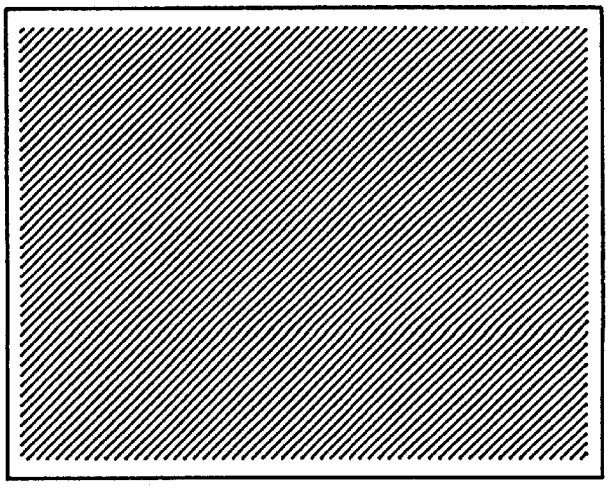
FIG. 22 shows a simplified plan view of the appearance of a typical coating obtained in Example 1.

The coated substrate was then dried in a drying oven (not shown in the drawing) for 20 min at 120° C. to obtain a green-pigmented coating. The thickness profile of the coating produced is as shown in FIG. 21, and a steady-state coating thickness was obtained except up to 9 mm from the start-of-coating line and 9 mm before the end-of-coating line. At both the beginning and the end of the coating area, the coating thickness was within the range from 88% to 108% compared with that in the steady-state thickness area. FIG. 22 is a plan view of a glass substrate being coated, where hatching indicates the coating formed. The coating produced in this embodiment was of good quality throughout the intended coating area, from the beginning to the end of the coating area, without discontinuity or peeling.

Comparative Example 1

Coatings were produced on substrates in the same manner as Example 1 except for the use of a gear pump instead of a syringe pump and the omission altogether of vertical movement of the die after the clearance was set to 75 μm, the operation for stopping the table on its forward direction travel to the glass substrate unloading position, squeegee coating, and the recovery of the coating liquid from the coating liquid bead by suction.

Figure 23:
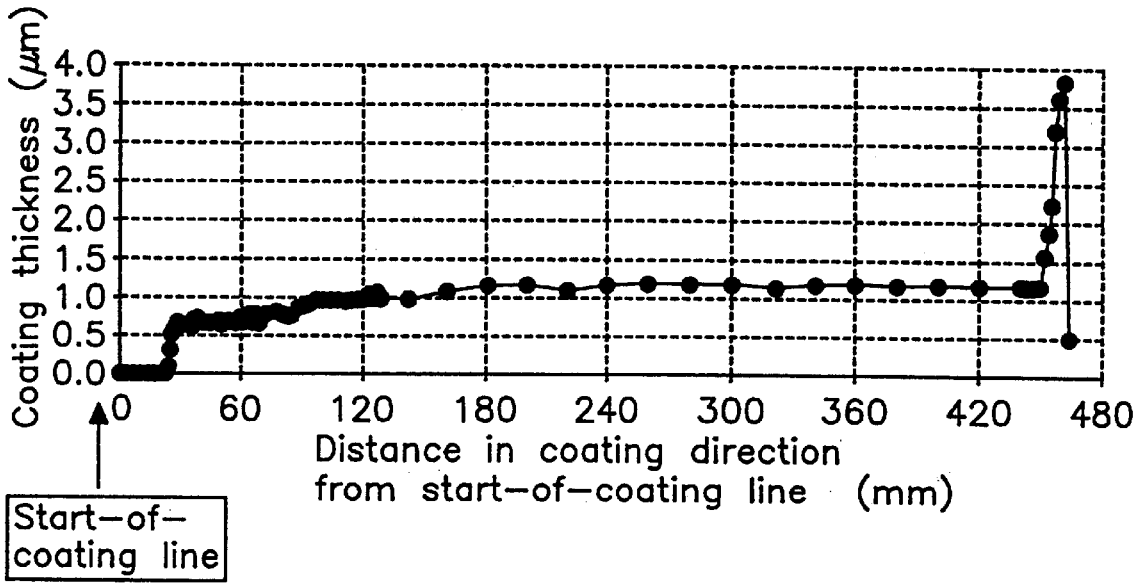
FIG. 23 shows a typical thickness profile of a coating obtained in Comparative Example 1.
Figure 24:
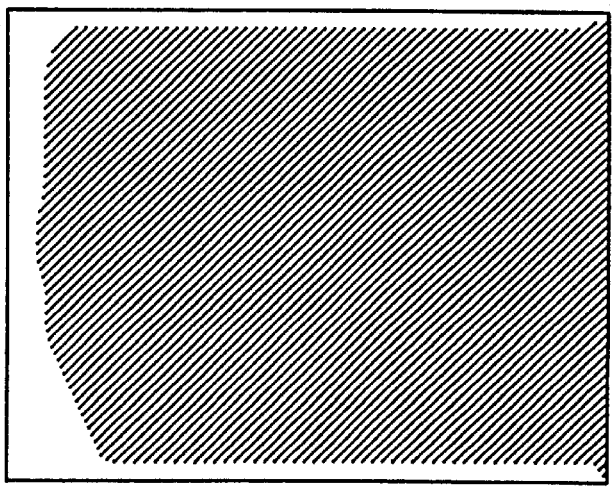
FIG. 24 shows a simplified plan view of the appearance of a typical coating obtained in Comparative Example 1.

A typical thickness profile of coatings obtained from Comparative Example 1 is as shown in FIG. 23, and a steady-state coating thickness was obtained in the intended coating area except for the sections within 180 mm behind the start-of-coating line and 40 mm before the end-of-coating line. Near the end of the coating area, there was a section where thickness measurements were more than 300% of those in the steady-state thickness section. The state of a coating formed on a glass substrate in this comparative example as viewed from above is shown in FIG. 24, where the coated area is shown with hatching, and the coating was not formed over the width direction within 22 mm behind the start-of-coating line, leaving an uncoated portion.

Comparative Example 2

Figure 25:
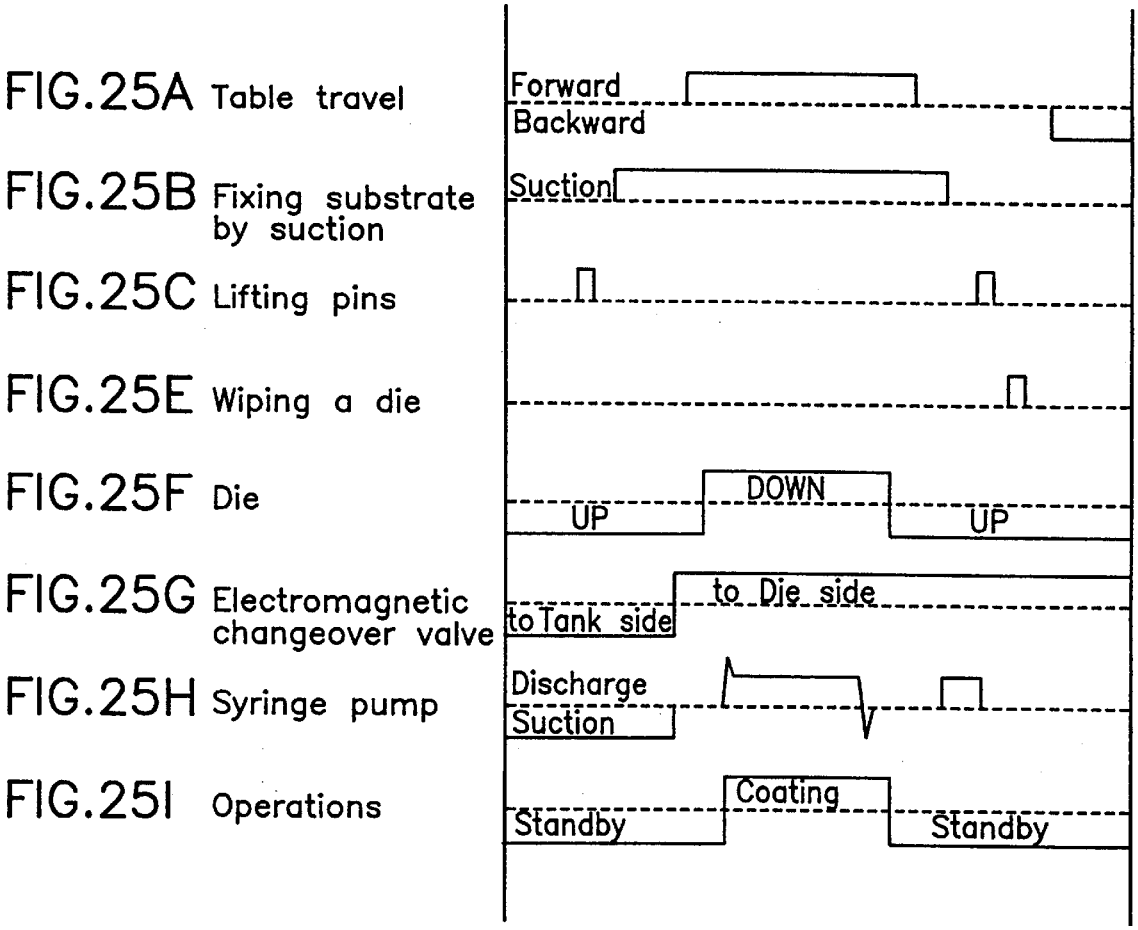
FIG. 25 shows a schematic diagram of the operation of each device in Comparative Example 2.

In this comparative example, coatings were produced on a substrate in the same manner as Example 1 except that instantaneous positive pulses were generated in discharging the coating liquid almost at the same time when the substrate passed right under the die, where positive means a direction to which coating liquid was discharged, instead of the omission of stopping the table at the start-of-coating line on its forward direction travel, and that negative pulses were generated in discharging the coating liquid instead of the omission of the squeegee coating at the end-of-coating line, as shown in the time chart in FIG. 25.

Figure 26:
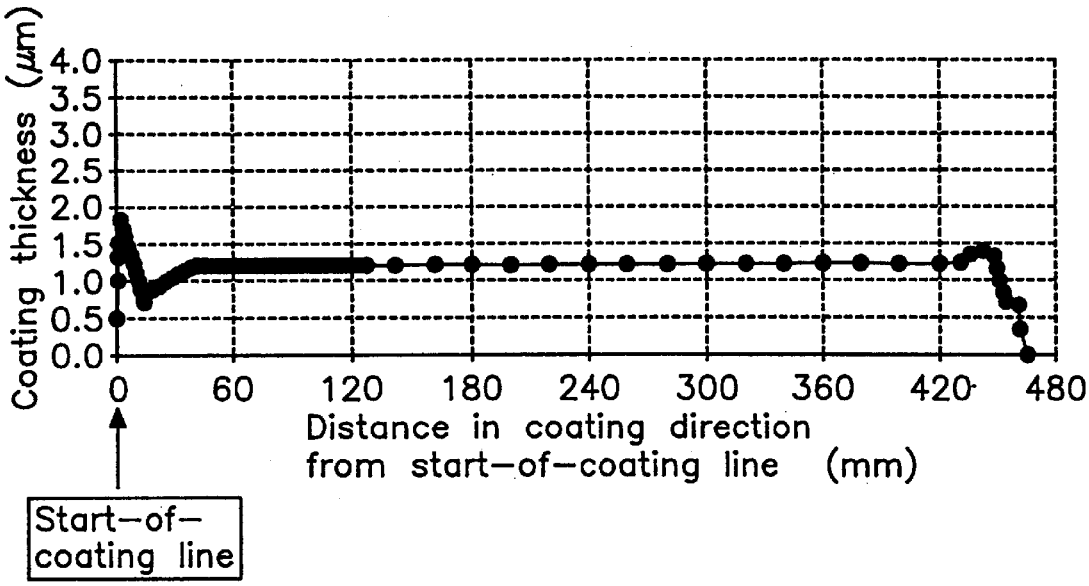
FIG. 26 shows a typical thickness profile of a coating obtained in Comparative Example 2.
Figure 27:
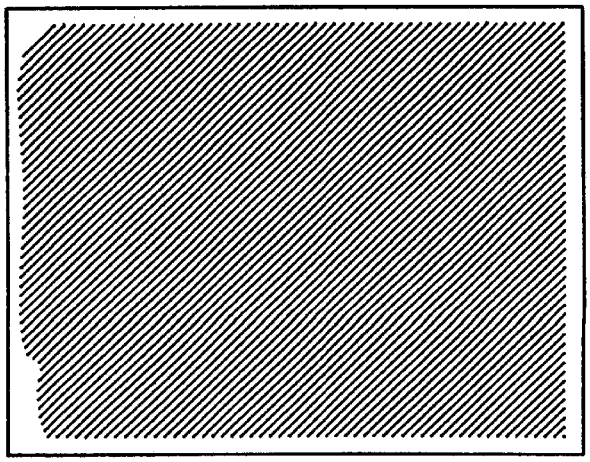
FIG. 27 shows a simplified plan view of the appearance of a typical coating obtained in Comparative Example 2.

A typical thickness profile of coatings obtained is as shown in FIG. 26, and a steady-state coating thickness was obtained in the intended coating area except for the sections within 28 mm behind the start-of-coating line and 20 mm before the end-of-coating line. Due to instability in the formation of the coating liquid bead, a temporary fall in the coating thickness was observed near the start-of-coating line. This tendency remained even when a rate of the coating liquid discharge or a table traveling speed was changed. The state of the coating produced on the glass substrate in this comparative example as viewed from above is shown in FIG. 27, where the coated area is shown with hatching. According to this drawing, the generation of positive pulses in discharging the coating liquid alone could not form a uniform coating liquid bead throughout the width of the substrate, and the coating was not formed widthwise up to 8 mm behind the start-of-coating line, leaving an uncoated section. Although an increase in the magnitude of the pulses at the beginning of coating made it possible to produce a coating throughout the width right from the start-of-coating line, the resulting discharge of an excessive amount of the coating liquid increased the coating thickness near the start-of-coating line, to about three times the predetermined thickness.

Compared with Comparative Examples 1 and 2, Example 1 can provide a larger steady-state coating area, with the coating formed with a remarkably small margin near the edge of the substrate. With Example 1, furthermore, variations in coating thickness near the beginning and the end of the coating area were also greatly reduced, which is highly advantageous in a case where an advanced coating processing such as patterning is to be performed in a subsequent step.

Example 2

A coating liquid for blue-pigmented coating, with a solid content by weight of 7 wt % and a viscosity of 20 centipoise, was prepared by dispersing Phthalocyanine Blue (C.I. Pigment Blue 15:4), to which Dioxazine Violet (C.I. Pigment Violet 23) has been added with a polyamic acid, a polyimide precursor, as binder in N-methyl-2-pyrrolidone as solvent. Similarly, a coating liquid for green-pigmented coating, with a solid content by weight of 8 wt % and a viscosity of 25 centipoise, was prepared by mixing and dispersing chlorinated and brominated Phthalocyanine Green (C.I. Pigment Green 36) in N-methyl-2-pyrrolidone as the solvent. Furthermore, a coating liquid for red-pigmented coating, with a solid content of 5 wt % and a viscosity of 120 centipoise, was prepared by mixing Dianthraquinonyl Red (C.I. Pigment Red 177). A non-alkali glass substrate (OA-2), measuring 465 mm×360 mm×1.1 mm covered with patterned chromium as a photo-shielding layer was retained on the table 6 by means of suction. Simultaneously with these operations, the electromagnetic changeover valve 46 was switched over to the coating liquid tank 50, and the syringe pump 44 was activated for suction and was filled with the coating liquid. The filled volume was 5,170 μl for the coating liquid for the red-pigmented coating, and 3,100 μl for each of the coating liquid for the green-pigmented coating and the coating liquid for the blue-pigmented coating respectively. The electromagnetic changeover valve 46 was then switched over to the coating die to stand by for coating. At the same time, the die 40 was lowered to a position necessary to secure a 75 μm clearance. Then, the table 6 was driven to move the glass substrate to a position right under the die 40 and stopped. The arrival of the table 6 to the position right under the die 40 was detected with a number of steps generated by an encoder provided near the AC servomotor which drove the table 6, and then the syringe pump 44 was activated to start the discharge of the coating liquids of at a discharging rate of 518 μl/sec for the coating liquid for red-pigmented coating, 308 μl/sec for each of the coating liquid for green-pigmented coating and the coating liquid for the blue-pigmented coating respectively. After the substrate was maintained held at rest for 0.4 sec for the coating liquid for red-pigmented coating and 0.3 sec for the coating liquid for each of the green-pigmented coating and the coating liquid for blue-pigmented coating respectively from the beginning the discharge of the coating liquid, the table was moved again at 3 m/min to start the coating operation.

When the arrival of the table at a point 5 mm before the end-of-coating line was detected by counting the number of steps of encorder for the AC servomotor which drives the table, the syringe pump 44 was stopped, while the table 6 continued traveling. The rest of the coating area from this position to the end-of-coating line was coated with the so-called squeegee coating method in which coating is undertaken by consuming the coating liquid bead C formed between the glass substrate and die 40.

When the substrate reached the end-of-coating line, the syringe pump 44 was operated in the opposite direction, to withdraw by suction 90 μl of the coating liquid bead C through the discharge outlet 66 of the die at a rate of 360 μl/sec. Even during this operation, the table continued to travel at 3 m/min towards the unloader substrate transfer position.

After that, the die 40 was raised away from the glass substrate to end the coating operation. The syringe pump 44 was then activated in the forward direction, to fill the die with 90 μl of coating liquid. The coated substrate was then dried at 120° C. for 20 min in a drying oven, and a positive resist was applied on the coating using the spinner method. Patterning by the so-called photolithographic technique involving masked exposure, development and etching was then carried out, followed by heating so as to perform an imidation reaction thereby to create red pixels. This process was repeated for the blue and green coatings in turn under appropriate conditions to obtain pixels of red, green and blue, the three primary colors of light. A polyimide layer of 0.9 μm thick was formed as a protective layer on the glass substrate on which pixels had been developed, and an indium-tin oxide film of 0.1 μm thick was further provided on this layer by sputtering to form a transparent conductive layer, resulting in a color filter. Four color filters measuring 10.4 in. diagonally were produced on this one glass substrate. For assessment purposes, pixel layer thicknesses of the same color was measured for each color after forming a pattern of each color. Pixels for each color were free of significant variations in coating thickness, and the color filters produced exhibited excellent characteristics.

Example 3

After a coating liquid for red-pigmented coating was applied in the same manner as Example 2, vacuum solvent removal was carried out by holding the coated substrate at 70° C. and 2 Torr for 3 minutes, followed by drying on a hot plate (not shown in the drawing) at 130° C. for 10 minutes. A positive photoresist (26.7 wt %, 20 centipoise) was then applied over the coated surface and dried to obtain a photoresist layer 1.6 μm thick, in the same manner as the process for the coating liquid for the red-pigmented coating except for that the filled volume was 1,100 μl, the discharging coating liquid rate was 109 μl/sec and the time for maintaining the substrate at rest at the beginning of coating was 0.8 sec.

Red pixels were then produced through patterning performed using the so-called photolithographic technique involving masked exposure, development and etching, and heating to perform an imidation reaction. The red pixel width was in a range of 90 μm (design value) ±1 μm, which was very precise, and there was no fluctuation of the width due to variations in the thickness of the photoresist layer. By repeating this process for the blue and green coatings in turn under appropriate conditions, pixels of three primary color, i.e. red, green and blue, were obtained. A die was used which measured 0.5 mm and 3.5 mm in the lengths of the bottom surfaces of the front lip and rear lip, $L_F$ and $L_R$, respectively, 100 μm in the width of the slot exit aperture, $L_P$, 360 mm in the length of the slot exit aperture, W (i.e. a length in the lengthwise direction of the die), in the direction perpendicular to the coating direction.

A volume of the coating liquid, V, to be discharged to form a coating liquid bead while the table was maintained at rest at the beginning of coating was set at 104 μl, 92 μl, 92 μl for red, green and blue, respectively, to satisfy the condition that it is equal to or greater than $[L_P \times L_C \times W]$ and equal to or smaller than $[(L_F+L_R+L_P) \times L_C \times W]$.

A polyimide layer 0.9 μm thick was formed as a protective layer on the glass substrate on which pixels had been provided by the above opearation, and a indium-tin oxide film 0.18 μm thick was further formed on this layer by sputtering to form a transparent conductive layer, resulting in color filters. Four color filters measuring 10.4 in. diagonally were produced on this one glass substrate. For assessment purposes, pixel layer thicknesses of the same color were measured for each color after forming a pattern of each color. Pixels for each color were uniform in coating thickness, and the color filters produced exhibited excellent characteristics.

Example 4

A coating liquid for green-pigmented coating was applied on a glass substrate to produce a coating in the same manner as Example 1. The substrate was transfered onto the four proximity pins in the vacuum dryer by an unloader, which is provided by a cylindrical coordinates robot as shown in FIG. 20. The substrate and the hot plate which heats it faced each other, and were spaced apart by 3 mm, the distance corresponding to the length of the proximity pins. Vacuum drying was started by activating the vacuum pump as soon as the substrate had been transferred. The vacuum drying conditions were a pressure of 1 Torr, a hot plate temperature of 50° C. and a drying duration of 3 min. The time taken to reach about 1 Torr was about 30 sec. After drying, the dried substrate was transferred by another unloader to a hot-plate type heat curing apparatus. The coated and dried substrate was heated for a minute on the proximity pins (5 mm long) on the hot plate heated at 180° C., held for 3 minutes on the proximity pins (5 mm long) on the hot plate heated at 130° C., and cooled down on a cold plate to cure the dried coating.

The coating thickness after heat curing was 1.1 μm. The sample was inspected for any coating irregularity using a backlight for a liquid crystal display, and it was clear that the coating produced was free from defects such as pin marks due to uneven drying or temperature distribution, marks formed by the substrate transfer arm and marks formed by notches in the hot plates to facilitate for transferring.

Comparative Example 3

Coating, drying and heat curing were carried out in the same manner as Example 4 except for the omission of vacuum drying in a vacuum dryer, and holding for four minutes the coated substrate on the proximity pins (5 mm long) on the hot plate heated at 130° C.

Coating defects such as pin marks due to uneven temperature distribution, marks formed by the substrate transfer arm and marks formed notches in the hot plates to facilitate transferring, and sound coating liquid application and curing could not be achieved.

INDUSTRIAL APPLICABILITY

The present invention makes it possible to stably produce coated products with a high accuracy in coating position and coating thickness, without sacrificing the advantages of die coaters, such as economy, high accuracy thin-film coating performance and an enclosed coating liquid environment. It is particularly suitable for coating sheet substrates and can therefore be applied to manufacturing coated sheet products such as color filters for liquid crystal displays and solid-state television camera tubes, optical filters, printed circuit boards, integrated circuits and other semiconductor devices. It can present coated sheet products with an exceptional quality at low price.

What is claimed is:

1. A coating apparatus which comprises a feeding means to feed a coating liquid, a coating liquid applicator having a discharge slot extending in one direction to discharge the coating liquid fed by the feeding means, and a conveying means to move at least either the coating liquid applicator or a substrate to be coated with the coating liquid relative one to the other, and said apparatus further comprising:

(a) a first control means which comprises, (a-1) a position detecting means to detect position of the coating liquid applicator or the substrate either of which is moved by the conveying means and (a-2) a controller capable of stopping the coating liquid applicator or the substrate which is moved by the conveying means at a position that is detected by the position detecting means, such that a start-of-coating line of the substrate is registered by the position detecting means upon alignment of the start-of-coating line with the slot of the coating liquid applicator, and which controller is capable of starting movement of either the coating liquid applicator or the substrate that is stopped at said position and maintaining the clearance between the exit aperture of the slot of the coating liquid applicator and the substrate at the start-of-coating line; and (b) a second control means which comprises a timer controller capable of transmitting a signal to the controller of the first control means for movement of the coating liquid applicator or the substrate which is stopped at said position, after a predetermined period which begins with commencement of feeding the coating liquid and is needed for forming a coating liquid bead which is in contact with both the exit aperture of the slot of the coating liquid applicator and the substrate at the start-of-coating line and by the second control means said predetermined period and the volume of the coating liquid bead formed at the start-of-coating line are controlled to regulate a profile of the thickness of the coating liquid coated at the starting portion of coating on the substrate.

2. A coating apparatus according to claim 1, wherein the coating liquid applicator has at least a front lip and a rear lip, which are arranged together in the direction of the relative movement of the substrate with the front lip being first with respect to the direction of the relative movement and wherein said volume V in $mm^3$ of the coating liquid dispensed from the slot of the coating liquid applicator after stopping the substrate to form the coating liquid bead satisfies the following formula:

$$L_P \times L_C \times W \leqq V \leqq (L_F + L_P + L_R) \times L_C \times W,$$

where LF in mm is a length of the bottom surface of the front lip which surface is parallel to the direction of the movement, LR in mm is a length of the bottom surface of the rear lip which surface is parallel to the direction of the relative movement, LP in mm is a width across the exit aperture of the slot, LC in mm is said clearance between the exit aperture of the slot and the substrate at the start-of-coating line, and W in mm is a length of the exit aperture of the slot in the direction perpendicular to the direction of the relative movement.

3. A coating apparatus according to claim 2, further comprising the feature that the length of the bottom surface of the rear lip is longer than that of the bottom surface of the front lip in the direction of the relative movement.

4. A coating apparatus according to claim 3, further comprising the feature that the length of the bottom surface of the front lip is 0.01–0.5 mm measured in the direction of the relative movement, while the length of the bottom surface of the rear lip is 1–4 mm measured in the direction of the relative movement.

* * * * *